US010784029B2

(12) United States Patent
Takeda et al.

(10) Patent No.: US 10,784,029 B2
(45) **Date of Patent: *Sep. 22, 2020**

(54) R-T-B BASED PERMANENT MAGNET

(71) Applicant: TDK CORPORATION, Tokyo (JP)

(72) Inventors: Keiji Takeda, Tokyo (JP); Shota Miyazaki, Tokyo (JP)

(73) Assignee: TDK CORPORATION, Tokyo (JP)

( * ) Notice: Subject to any disclaimer, the term of this patent is extended or adjusted under 35 U.S.C. 154(b) by 232 days.

This patent is subject to a terminal disclaimer.

(21) Appl. No.: 15/939,536

(22) Filed: Mar. 29, 2018

(65) Prior Publication Data

US 2018/0294079 A1 Oct. 11, 2018

(30) Foreign Application Priority Data

Mar. 31, 2017 (JP) ..... 2017-071251
Mar. 23, 2018 (JP) ..... 2018-056838

(51) Int. Cl.

| | |
|---|---|
| ***H01F 1/057*** | (2006.01) |
| ***H01F 7/02*** | (2006.01) |
| ***B22F 3/10*** | (2006.01) |
| ***C22C 38/00*** | (2006.01) |
| ***C22C 38/10*** | (2006.01) |

(52) U.S. Cl.

CPC ..... *H01F 1/057* (2013.01); *C22C 38/005* (2013.01); *C22C 38/10* (2013.01); *H01F 1/0577* (2013.01); *H01F 7/02* (2013.01); *C22C 2202/02* (2013.01)

(58) Field of Classification Search

None

See application file for complete search history.

(56) References Cited

U.S. PATENT DOCUMENTS

| | | | |
|---|---|---|---|
| 2002/0062884 | A1 | 5/2002 | Kaneko et al. |
| 2009/0032147 | A1 | 2/2009 | Nozawa et al. |
| 2011/0000586 | A1 | 1/2011 | Nomura et al. |

(Continued)

FOREIGN PATENT DOCUMENTS

| | | | |
|---|---|---|---|
| CN | 101178963 | A * | 5/2008 |
| DE | 60119864 | T2 | 9/2006 |

(Continued)

OTHER PUBLICATIONS

Machine China Translation of CN101178963A. (Year: 2008).*

*Primary Examiner* — Xiaowei Su
(74) *Attorney, Agent, or Firm* — Oliff PLC

(57) ABSTRACT

An object of the present invention is to provide an R-T-B based permanent magnet having a low coercive force and a low magnetizing field, and having a high residual magnetic flux density and a high minor curve flatness even in the low magnetizing field. Provided is an R-T-B based permanent magnet including a main phase including a compound having an $R_2T_{14}B$ type tetragonal structure and a grain boundary phase existing between the main phases, in which R is at least one rare earth element including scandium and yttrium, T is at least one transition metal element including iron, or at least two transition metal elements including iron and cobalt, the grain boundary includes an R-T-B—C based compound having a higher R concentration, B concentration and C concentration than that of the main phase and having a lower T concentration than that of the main phase.

9 Claims, 5 Drawing Sheets

(56) References Cited

U.S. PATENT DOCUMENTS

| | | | | |
|---|---|---|---|---|
| 2011/0090032 | A1 | 4/2011 | Nagata et al. | |
| 2011/0233455 | A1* | 9/2011 | Yan | H01F 1/0577 252/62.55 |
| 2013/0271249 | A1 | 10/2013 | Suzuki et al. | |
| 2015/0211139 | A1 | 7/2015 | Nagasaki et al. | |
| 2015/0248953 | A1* | 9/2015 | Suzuki | H01F 1/057 252/62.51 R |
| 2018/0218834 | A1 | 8/2018 | Lv et al. | |
| 2018/0294080 | A1* | 10/2018 | Miyazaki | H01F 1/057 |

FOREIGN PATENT DOCUMENTS

| | | | |
|---|---|---|---|
| DE | 112016005949 | T5 | 9/2018 |
| JP | 2010-034522 | A | 2/2010 |
| JP | 2010-074084 | A | 4/2010 |
| JP | 2012-099852 | A | 5/2012 |
| WO | 2012/090765 | A1 | 7/2012 |

* cited by examiner

R-T-B BASED PERMANENT MAGNET

BACKGROUND OF THE INVENTION

1. Field of the Invention

The present invention relates to an R-T-B based permanent magnet. More particularly, the present invention relates to a permanent magnet suitable for a variable magnetic flux magnet constituting a variable magnetic force motor.

2. Description of the Related Art

A permanent magnet synchronous motor, which is capable of saving energy by inverter control and is highly efficient, has been used as a power unit of consumer, industrial and transportation equipment. However, according to the permanent magnet synchronous motor in which the magnetic flux of the permanent magnet is constant, driving at a wide rotation speed becomes difficult since the induced voltage increases in proportion to the rotation speed. For this reason, in order to prevent the induced voltage from the power supply voltage or more in a middle or high speed range and under a light load, a technique called a field weakening control, which cancels the magnetic flux of the permanent magnet by the demagnetizing field due to an armature current and reduces an interlinkage magnetic flux, is applied to the permanent magnet synchronous motors. However, armature current which does not contribute to the motor output is made to flow continuously, in order to continue applying the demagnetizing field. And as a result, there is a problem that efficiency of the motor is lowered.

To solve such problem, for example, Patent Document 1 discloses the variable magnetic force motor in which a low coercive force Sm—Co based permanent magnet (a variable magnetic flux magnet), whose magnetization reversibly changes by applying an external magnetic field, and a fixed magnetic flux magnet that applies a magnetic field to the variable magnetic flux magnet are combined. In the variable magnetic force motor, by reducing the magnetization of the variable magnetic flux magnet in a middle or high speed range and under a light load, it is possible to suppress the reduction of motor efficiency due to the conventional weaker magnetic field.

However, the Sm—Co based permanent magnet disclosed in Patent Document 1 has a problem of being a high cost, due to a high price of Co of the main raw material. In addition, the saturation magnetization of Sm—Co based permanent magnets, which are variable magnetic flux magnets, is about 12.5 kG at the maximum and does not reach the saturation magnetization of neodymium magnets which are the fixed magnetic flux magnets. Therefore, there is a problem that a difference in magnetic force between the fixed magnetic flux magnet and the variable magnetic flux magnet is generated, and the output and efficiency of the variable magnetic force motor are lowered.

Therefore, it is conceivable to apply the R-T-B based permanent magnet as the permanent magnet for the variable magnetic flux magnet.

Patent Document 2 discloses the R-T-B based permanent magnet, in which the residual magnetic flux density Br is 11 kG or more, the coercive force HcJ is 5 kOe or less, and the external magnetic field required to set the residual magnetic flux density Br to zero is 1.10 HcJ or less. The R-T-B based permanent magnet comprises crystal grains including a rare earth element R, a transition metal element T, and boron B, and the Cu content in the crystal grain is 0.5 to 0.6 atomic % with respect to the whole element of crystal grains.

Patent Document 3 discloses the permanent magnet whose composition is $(Ce_{1-x-y}R1_xR2_y)_aFe_bCo_cB_dM_eX_fC_gA_h$. R1 is at least one selected from Nd, Pr, Sm and La, and R2 is at least one selected from elements Tb, Dy and an element not selected from R1. Further, M is an element such as Ti, X is an element such as Ga, and A is at least one selected from F and O. It is described that this permanent magnet can change the magnetization state and has low coercive force.

Patent Document 4 discloses the R—Fe—B based magnet. In this R—Fe—B based magnet, powder grains, having an average crystal grain diameter of 0.01 μm or more and 2 μm or less and having a texture of $Nd_2T_{14}B$ type crystal phase, are bonded and rare earth rich phases exist in the region located between the powder grains. The number density of the rare earth rich phases is $1.6\times10^4$ pieces/mm$^2$ or more. However, this R—Fe—B based magnet is aimed at obtaining a high coercive force and does not have magnetic properties applicable to the variable magnetic flux magnet.

PRIOR ART

Patent Document 1: Japanese Patent Publication No. 2010-34522

Patent Document 2: International Publication No. 2012/090765

Patent Document 3: Japanese Patent Publication No. 2010-74084

Patent Document 4: Japanese Patent Publication No. 2012-99852

SUMMARY OF THE INVENTION

Disclosure of the Invention

The R-T-B based permanent magnet disclosed in Patent Document 2 shows higher residual magnetic flux density than the conventional Sm—Co based permanent magnet for the variable magnetic force motor. Thus, a high power output and a high efficiency of the variable magnetic force motor are expected. However, the R-T-B based permanent magnet disclosed in Patent Document 2 only describes the magnetic properties in a saturated magnetization state.

Here, the saturated magnetization state means a state in which the sample is magnetized by applying a saturation magnetic field. In order to realize the residual magnetic flux density in the saturated magnetization state, the R-T-B based permanent magnet disclosed in Patent Document 2 requires a magnetizing field Hmag that is at least three times or higher with respect to the coercive force. Therefore, despite that the R-T-B based permanent magnet described in Patent Document 2 has a low coercive force, the magnetizing field Hmag required for switching the magnetization of the R-T-B based permanent magnet becomes large. When the magnetizing field Hmag becomes large, there is a problem that it exceeds the upper limit of the magnetic field that can be applied by a stator coil of the motor.

In addition, the present inventors have found out that in order to widen the high-efficiency operation range of the variable magnetic force motor, it is necessary that the change in magnetization is small with respect to the change of the magnetic field in the minor loop related to magnetization switching. In particular, it is preferable that the change in magnetization is small from the second and third quadrants of the hysteresis curve to the first and fourth quadrants. In this specification, this desirable state is expressed as a high minor curve flatness.

Further, as the variable magnetic force motor, a continuously variable magnetization accompanied by a successive increase and decrease of magnetism from a certain partial magnetization state to another partial magnetization state is assumed. However, even if the minor curve flatness is high in the second and third quadrants, but is low in the first and fourth quadrants, it becomes difficult to magnetize to the desired magnetization state when the successive increase of magnetism is performed. For controllability of the continuously variable magnetization, it is required that the minor curve flatness from the second and third quadrants to the first and fourth quadrants is high.

However, even in the saturated magnetization state, the R-T-B based permanent magnet disclosed in Patent Document 2 has a large change in magnetization with respect to a change in the magnetic field. Therefore, in a minor loop when magnetized with a magnetic field lower than the saturation magnetic field, there was a problem that the change in magnetization with respect to the change in the magnetic field is further increased.

In Patent Document 3, it is described that when the magnetizing field is 10 kOe, the minor curve flatness in the second and third quadrants is relatively good, but the minor curve flatness in the first and fourth quadrants is not evaluated at all. When the minor curve flatness in the first and fourth quadrants is low, it is impossible to specify a reverse magnetic field for changing the magnetization, and becomes uncontrollable.

The present invention has been made in view of such circumstances. And an object of the present invention is to provide an R-T-B based permanent magnet having a low coercive force and a low magnetizing field, and having a high residual magnetic flux density and a high minor curve flatness even in the low magnetizing field.

In order to achieve the above object, the R-T-B based permanent magnet of the invention is

[1] an R-T-B based permanent magnet including a main phase including a compound having an $R_2T_{14}B$ type tetragonal structure and a grain boundary phase existing between the main phases, in which R is at least one rare earth element including scandium and yttrium, T is at least one transition metal element including iron, or at least two transition metal elements including iron and cobalt, and the grain boundary includes an R-T-B—C based compound having a higher R concentration, B concentration and C concentration than that of the main phase and having a lower T concentration than that of the main phase.

[2] The R-T-B based permanent magnet described in [1], in which a ratio of an area of the R-T-B—C based compound to an area of the grain boundary phase is 5% or more and 88% or less.

[3] The R-T-B based permanent magnet described in [1] or [2], in which a ratio B/R of B atom to R atom satisfies $0.3 \leq B/R \leq 0.7$ and a ratio C/R of C atom to R atom satisfies $0.6 \leq C/R \leq 1.4$ in the R-T-B—C based compound.

[4] The R-T-B based permanent magnet described in any one of [1] to [3], in which when R of the R-T-B based permanent magnet is represented by R1, R2 and Sm, R1 is at least one rare earth element comprising Nd and not comprising Y, Ce and Sm and R2 is at least one element selected from Y and Ce, and when a total number of atoms of R is 1, a ratio of a number of atoms of R2 to the total number of atoms of R is x, and a ratio of a number of atoms of Sm to the total number of atoms of R is y, x and y, being on a (x, y) plane, are on straight lines connecting point A (0.000, 0.050), point B (0.000, 0.150), point C (0.700, 0.100), point D (0.700, 0.000), and point E (0.300, 0.000) in the clockwise direction in this order, and in a region surrounded by the straight lines.

Effect of the Invention

According to the present invention, there is provided an R-T-B based permanent magnet having a low coercive force and a low magnetizing field, and having a high residual magnetic flux density and a high minor curve flatness even in the low magnetizing field can be provided.

Figure 1:
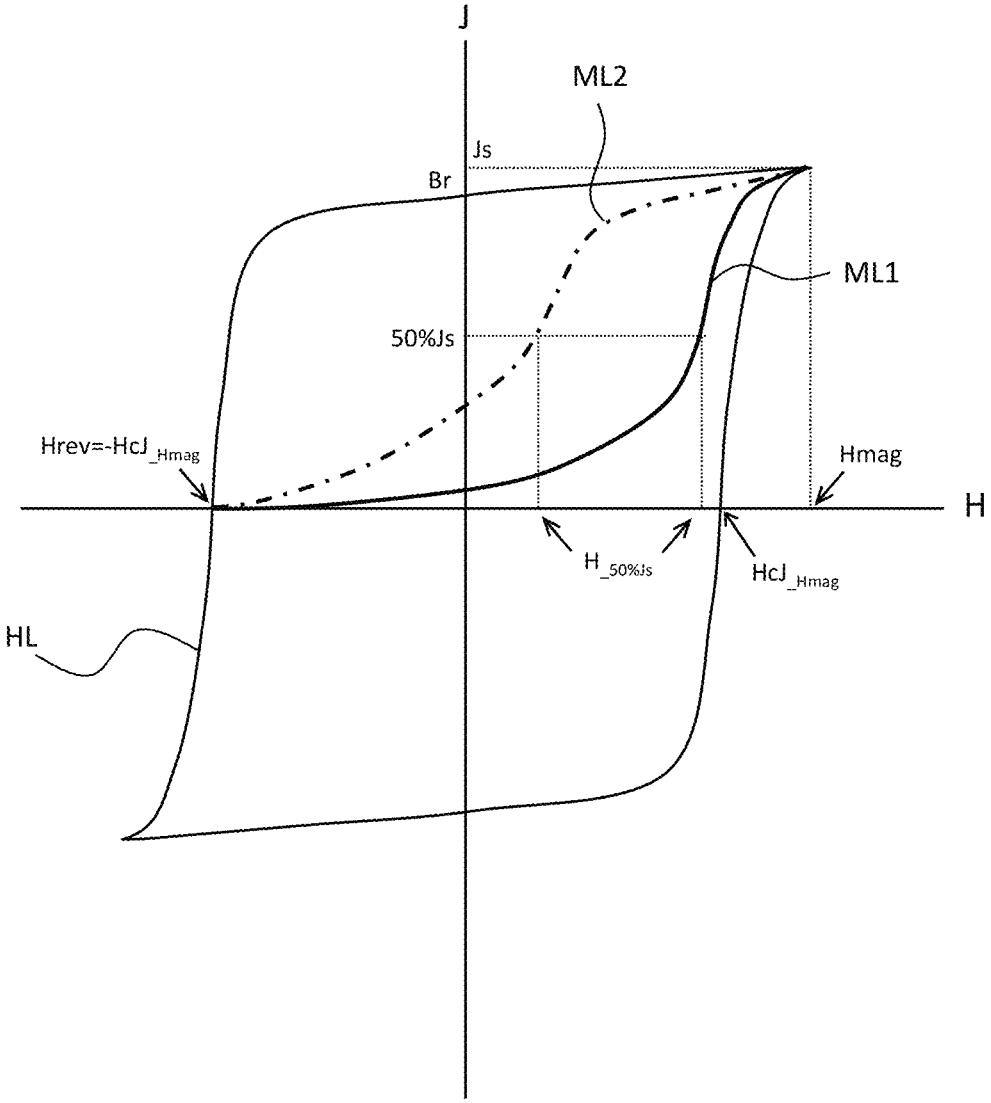
FIG. 1 is a schematic hysteresis loop for explaining properties required for the variable magnetic flux magnet.

Hereinafter, the present invention will be described in detail based on the concrete embodiments in the following order.

1. Properties required for the variable magnetic flux magnet
2. R-T-B based permanent magnet
   2.1 Main phase crystal grains
   2.2 Grain boundary phase
   2.2.1 R-T-B—C based compound
   2.3 Composition of the R-T-B based permanent magnet
3. Process for the production of the R-T-B based permanent magnet
   3.1 Alloy producing step
   3.1.1 HDDR process
   3.2 Pulverizing step
   3.3 Pressing step
   3.4 Sintering step
4. Effects in the present embodiment

1. Properties Required for the Variable Magnetic Flux Magnet

The R-T-B based permanent magnet according to the present embodiment is a magnet suitable for the variable magnetic flux magnet. Therefore, properties required for the variable magnetic flux magnet will be described.

The variable magnetic flux magnet is a magnet that can switch the magnetization state by an external magnetic field and can reversibly realize a high magnetization state and a low magnetization state. In the variable magnetic force motor incorporating such variable magnetic flux magnet, the magnetic field of the armature or the like is controlled in accordance with the rotation speed and the load condition. And the magnetization state of the variable magnetic flux magnet is controlled so that the variable magnetic flux magnet shows a large magnetic flux when a high torque is required (at the time of low rotation speed or under high load) and a small magnetic flux when a high torque is not required (at the time of high rotation speed or under low load). With such variable magnetic flux magnet, it is possible to increase the efficiency of the variable magnetic force motor regardless of the torque value.

The magnetization state of the variable magnetic flux magnet can be switched in accordance with a predetermined minor loop. The minor loop is a magnetization changing behavior shown when the magnetic field is increased again after applying a negative reverse magnetic field on the hysteresis loop HL shown in FIG. 1. The minor loop of the present embodiment is a magnetization changing behavior in the case of magnetizing by applying a positive direction magnetic field Hmag and then applying the negative reverse magnetic field Hrev and again sweeping the magnetic field to the magnetic field Hmag.

As the properties required for the variable magnetic flux magnet, first, it is necessary to reduce the magnetizing field Hmag required for switching the magnetization in consideration of energy saving and the upper limit of the external magnetic field. In the present embodiment, the magnetizing field Hmag is defined as the minimum necessary magnetic field which can obtain reproducibility against repeated measurement. To lower the magnetizing field Hmag, the coercive force of the variable magnetic flux magnet is required to be small.

Also, in order to widen the range in which the variable magnetic force motor can operate with high efficiency, it is necessary to increase the magnetization changing amount between magnetization and demagnetization of the variable magnetic flux magnet. And for this, the residual magnetic flux density Br of the minor loop is required to be high in the magnetizing field Hmag.

Furthermore, when sweeping the magnetic field from the negative reverse magnetic field Hrev to the magnetic field Hmag in the minor loop, it is desirable that the magnetization does not to change untill the magnetic field as close as possible to Hmag, that is, from the second and third quadrants to the first and fourth quadrants of the hysteresis curve. This is because when the magnetization changes, problems such as narrowing the variable range of the magnetization, making it difficult to control the magnetization, etc. occur.

As described above, the change state of the above magnetization can be represented by an index called a minor curve flatness. In the present embodiment, the minor curve flatness is defined as the ratio of a magnetic field $H_{-50\%\ Js}$, where the magnetization of the minor loop from magnetization of zero is inverted by 50% with respect to the saturation magnetization Js, and the coercive force $HcJ_{-Hmag}$. That is, the minor curve flatness=100×($H_{-50\%\ Js}/HcJ_{-Hmag}$). The higher the minor curve flatness is, the smaller the change in magnetization from the negative reverse magnetic field Hrev to the magnetic field Hmag is, which is preferable.

For example, in FIG. 1, when the magnetic field is swept from $H_{mag}$ to the negative reverse magnetic field Hrev=−$HcJ_{-Hmag}$, and then to $H_{mag}$ again, the magnetization changes along ML1 or ML2. In the case where the magnetization changes along ML1, the change in magnetization is small even if the magnetic field is swept from $H_{rev}$ to $H_{mag}$, and $H_{-50\%\ Js}$ is very close to $HcJ_{-Hmag}$. Therefore, if the magnetization changes along ML1, the minor curve flatness is high.

On the other hand, if the magnetization changes along ML2, the magnetization changes quickly when sweeping the magnetic field from $H_{rev}$ to $H_{mag}$, and $H_{-50\%\ Js}$ is much smaller than $HcJ_{-Hmag}$. Therefore, if the magnetization changes along ML2, the minor curve flatness is low.

Incidentally, the R-T-B based permanent magnet has a nucleation type magnetization reversal mechanism. For this reason, the main phase crystal grains usually have a multi domain structure. Domain walls exist in the grains and remain up to the high magnetizing field Hmag. Thus, the domain walls can easily move according to the external magnetic field and the magnetization changes greatly. In addition, the nucleation magnetic field differs in each grain. Even with this factor, the magnetization greatly changes according to the external magnetic field.

That is, the R-T-B based permanent magnet, considering its mechanism, is poor in magnetizability at a low magnetizing field Hmag. Also, when sweeping the magnetic field from the negative reverse magnetic field Hrev to the magnetic field Hmag in the minor loop, the magnetization of the R-T-B based permanent magnet is more likely to change as compared with that of the pinning type magnet, considering the mechanism of the R-T-B based permanent magnet.

Therefore, in order to suppress the change in magnetization of the magnet in the demagnetization process after magnetization at the positive direction magnetic field Hmag and in the magnetization process from the negative reverse magnetic field Hrev in the R-T-B based permanent magnet, it is preferable that the $R_2T_{14}B$ main phase crystal grains responsible for the magnetic properties of the R-T-B based permanent magnet have a single domain structure even when the magnetizing field Hmag is low, and the single domain structure after magnetization is stable.

In addition, therefore, in the present embodiment, it is necessary to reduce the diameter of the main phase crystal grains so that the main phase crystal grains will stably have single domain structures.

The reason why the nucleation magnetic field differs in each grain is that a size distribution of the main phase crystal grains varies widely. Therefore, to improve the minor curve flatness, it is not enough to reduce the diameter of the main phase crystal grains, and it is necessary to narrow the size distribution. That is, it is necessary to suppress the main phase crystal grains from becoming coarse grains. Both the stabilization of the single domain structure and the equalization of the nucleation magnetic field are hindered when the main phase crystal grains become coarse grains.

2. R-T-B Based Permanent Magnet

Figure 2:
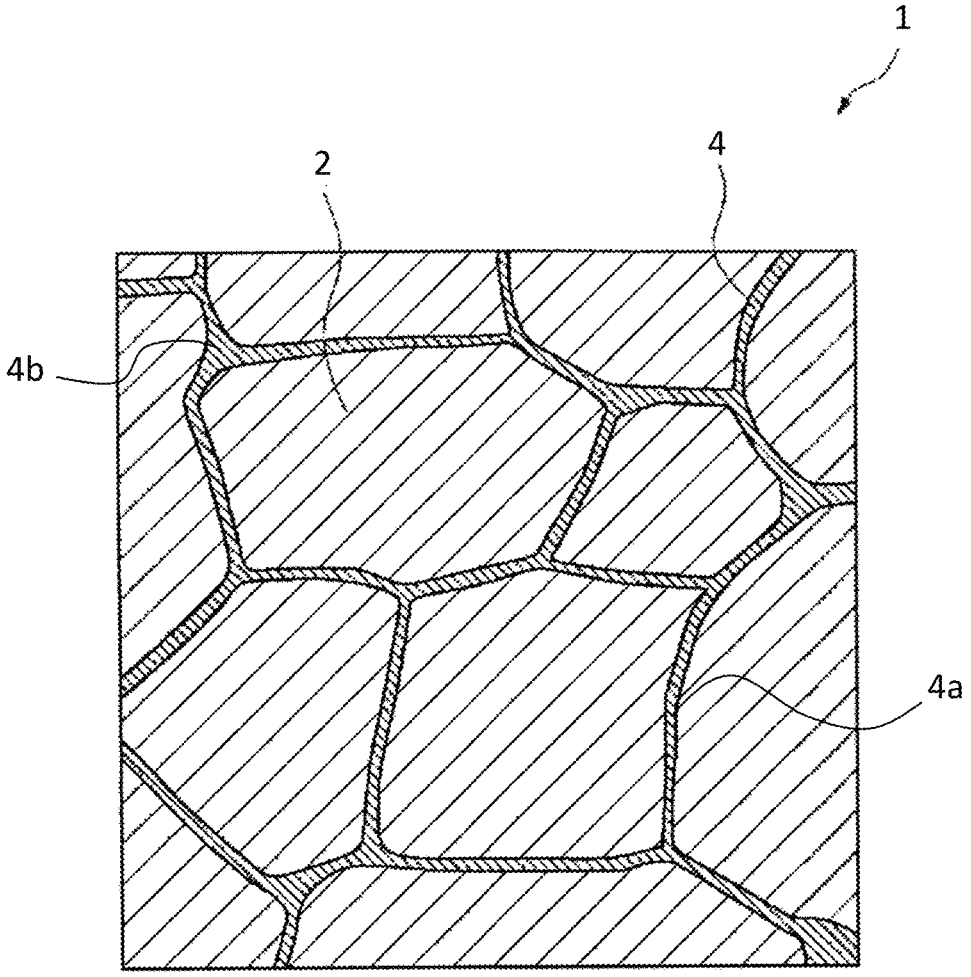
FIG. 2 is a schematic view showing a cross section of the R-T-B based permanent magnet according to the present embodiment.

The R-T-B based permanent magnet according to the present embodiment includes main phase including a $R_2T_{14}B$ type tetragonal structure and grain boundary phases existing between the main phases. Hereinafter, a compound having the $R_2T_{14}B$ type tetragonal structure is also referred to as an $R_2T_{14}B$ compound. Further, the R-T-B based permanent magnet according to the present embodiment is a sintered magnet obtained by sintering a molded body obtained by pressing a raw material alloy powder. Therefore, as shown in FIG. 2, in the R-T-B based permanent magnet 1 according to the present embodiment, the above main phase exists as a plurality of main phase crystal grains 2, and a grain boundary phase 4 exists between the main phase crystal grains 2.

In the present embodiment, the R-T-B based permanent magnet may have an overcoat made of a resin, a metal, etc. on its surface for preventing oxidation.

(2.1 Main Phase Crystal Grains)

In the present embodiment, the main phase crystal grains include the $R_2T_{14}B$ compound. The main phase crystal grains exhibit ferromagnetism and are responsible for the magnetic properties of the R-T-B based permanent magnets.

(2.1.1 Composition of Main Phase Crystal Grains)

R in the $R_2T_{14}B$ compound is one or more selected from rare earth elements including scandium (Sc) and yttrium (Y). The rare earth elements are Sc, Y and the lanthanoid elements belonging to the third group of the long period type periodic table. The lanthanoid elements are Lanthanum (La), Cerium (Ce), Praseodymium (Pr), Neodymium (Nd), Promethium (Pm), Samarium (Sm), Europium (Eu), Gadolinium (Gd), Terbium (Tb), Dysprosium (Dy), Holmium (Ho), Erbium (Er), Thulium (Tm), Ytterbium (Yb) and Lutetium (Lu).

In this embodiment, from the viewpoint of reducing the coercive force, it is possible to divide R of the R-T-B based permanent magnet into three groups of R1, R2, and Sm. Specifically, R1 is at least one rare earth element including Nd and not including Y, Ce and Sm, and R2 is at least one element selected from Y and Ce. Y and Ce show smaller anisotropic magnetic field of $R_2T_{14}B$ compounds than R1 such as Nd. In addition, since $Sm_2T_{14}B$ compound has an in-plane anisotropy, the strong anisotropic magnetic field exhibited by the $R_2T_{14}B$ compound can be lowered dramatically with a small amount. Therefore, by replacing Nd with one or more selected from Y and Ce and/or Sm, the coercive force of the R-T-B based permanent magnet can be reduced. Furthermore, by controlling the rate of substitution of R1 with R2 and Sm, the coercive force of the R-T-B based permanent magnet can be reduced and in addition, the magnetic properties suitable for the variable magnetic flux magnet can be further enhanced.

In case where R of the R-T-B based permanent magnet includes the above R1, R2 and Sm, when the total number of atoms of R included in the R-T-B based permanent magnet is considered one, R can be expressed as $R1_{1-x-y}R2_xSm_y$ when the ratio of number of atoms of R2 to the total number of atoms of R is "x" and the ratio of number of atoms of Sm to the total number of atoms of R is "y".

Since most of the R included in the R-T-B based permanent magnet is included in the main phase crystal grains, the $R_2T_{14}B$ compound can be expressed as $(R1\text{-}R2\text{-}Sm)_2T_{14}B$ compound including R1, R2 and Sm at a predetermined ratio.

Figure 3:
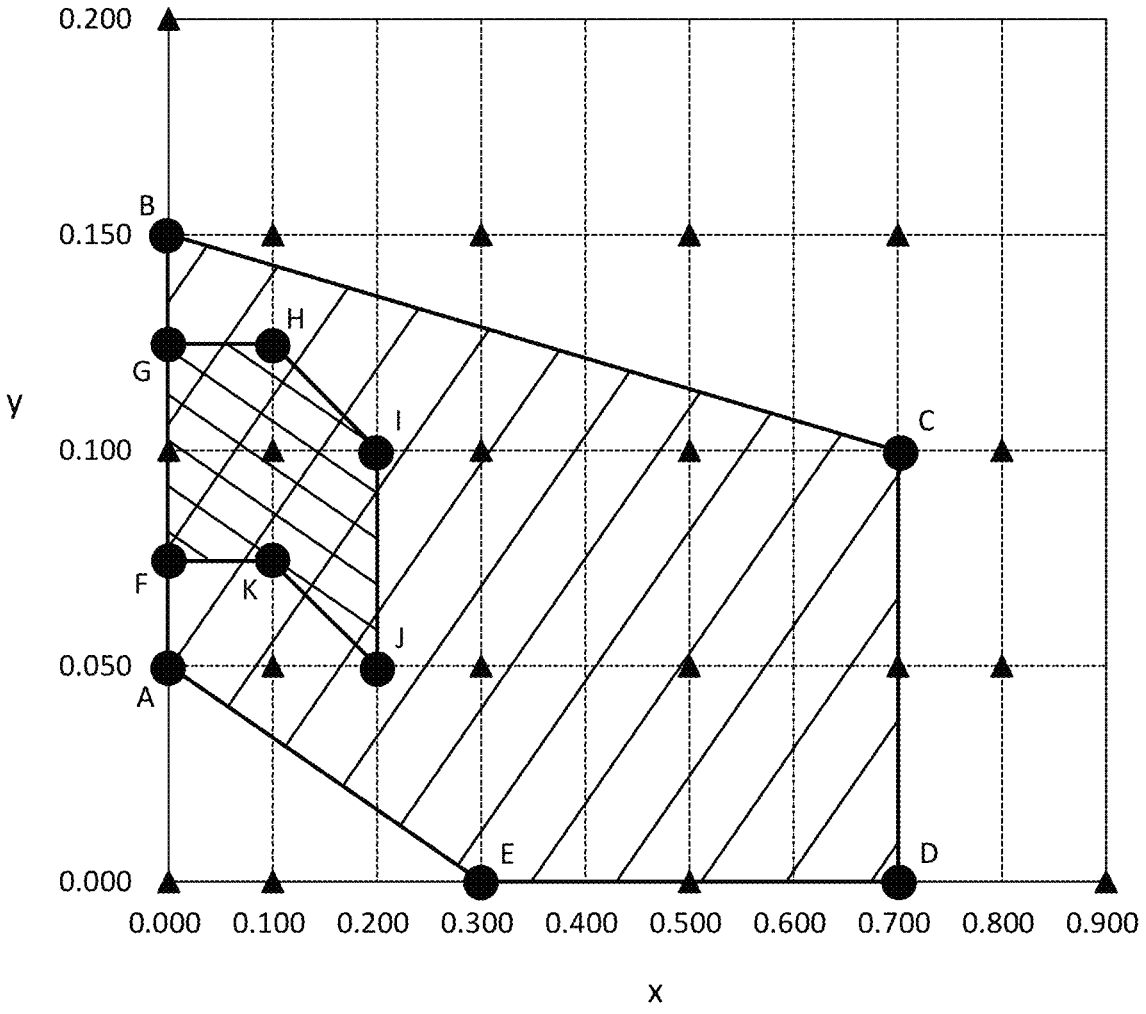
FIG. 3 is a graph showing the relationship between a ratio of the number of atoms of R2 and a ratio of the number of atoms of Sm when the total number of atoms of R1, R2, and Sm is one. R1, R2, and Sm constitute the rare earth elements included in the R-T-B based permanent magnet according to the present embodiment.

Therefore, in the present embodiment, x and y are preferably on straight lines connecting point A (0.000, 0.050), point B (0.000, 0.150), point C (0.700, 0.100), point D (0.700, 0.000), and point E (0.300, 0.000) shown in FIG. 3, in the clockwise direction in this order, and in a region surrounded by the straight lines, which is the hatched part in FIG. 3. By setting x and y within the above range shown in FIG. 3, the magnetizing field is also lowered while further lowering the coercive force of the magnet, and a high residual magnetic flux density and a preferable minor curve flatness can be obtained at such low magnetizing field.

In addition, x and y are further preferably on straight lines connecting point F (0.000, 0.075), point G (0.000, 0.125), point H (0.100, 0.125), point I (0.200, 0.100), point J (0.200, 0.050) and point K (0.100, 0.075) shown in FIG. 3, in the clockwise direction in this order, and in a region surrounded by the straight lines, which is the cross hatched part in FIG. 3. By setting x and y within the above range shown in FIG. 3, the above effects can be further enhanced.

It is further preferable that x and y are x=zero and $0.075 \leq y \leq 0.125$. That is, it is more preferable to substitute R1 with Sm within the above range. When x and y satisfy the above relationship, the above effect can be further enhanced.

In this embodiment, T in the $R_2T_{14}B$ compound is at least one transition metal elements including iron (Fe), or at least two transition metal elements including iron (Fe) and cobalt (Co). Co is an element included in the $R_2T_{14}B$ compound according to the properties required for the R-T-B based permanent magnet, and its content may be set according to the properties. In the present embodiment, the Co amount is preferably zero at % or more and 10 at % or less with respect to the T amount.

When the Co amount is within the above range, Curie temperature in the R-T-B based permanent magnet can be higher, and it is possible to suppress the decrease in the coercive force due to the temperature rise. Furthermore, the corrosion resistance of the R-T-B based permanent magnet can be improved.

In the present embodiment, part of boron (B) may be replaced with carbon (C) in the $R_2T_{14}B$ compound. C is an element included in the $R_2T_{14}B$ compound according to the properties required for the R-T-B based permanent magnet, and its content may be set according to the properties. In the present embodiment, the C amount is preferably zero at % or more and 40 at % or less with respect to the amount of (B+C).

(2.1.2 Diameter of the Main Phase Crystal Grains)

As described above, the diameter of the main phase crystal grains has a great influence on the properties required for the variable magnetic flux magnet, particularly the minor curve flatness. Therefore, in the present embodiment, D50 in the diameter distribution of the main phase crystal grain is preferably 1.40 μm or less. Hereinafter, D50 is defined as the average diameter of the main phase crystal grains. It is more preferable that D50 is 0.30 μm or more and 1.40 μm or less. More preferably, D50 is 0.50 μm or more and 1.00 μm or less. D50 is an index of the size of the diameter of the main phase crystal grains and when D50 is within the above range, it can be judged that the diameter of the main phase crystal grains is small.

In addition, D90 in the diameter distribution of the main phase crystal grains is preferably 3.00 μm or less. D90 is more preferably 2.00 μm or less, and more preferably 1.40 μm or less. D90 is an index of the diameter distribution of the diameter of the main phase crystal grains. When D90 is within the above range, it can be judged that the diameter distribution of the diameter of the main phase crystal grains is narrow.

Further, as D90 is closer to D50, there are less coarse grains abnormally grown, and as D90 is further away from D50, there are more coarse grains.

D50 and D90 are controlled by the HDDR process described later, the R-T-B—C phase described later, sintering conditions, etc.

When D50 is too large, since the diameter of the main phase crystal grains becomes large, the single domain structure of the main phase crystal grains become unstable and the minor curve flatness tends to decrease.

When D50 is small and grain growth is insufficient, the sintering is insufficient, and voids tend to be formed in the sintered magnet. When the voids are formed, Br tends to decrease, which is not preferable. Also, as D50 becomes smaller, $HcJ_{_Hmag}$ also tends to increase, which is not preferable. Therefore, in the present embodiment, it is preferable that the lower limit of D50 is 0.30 μm.

D90 tends to be particularly influenced by the R-T-B—C phase. In the absence of the R-T-B—C phase, the main phase crystal grains are likely to become coarse grains and D90 tends to exceed the above range when sintered at a sintering temperature at which a dense sintered magnet is obtained. As a result, the single domain structure of the main phase crystal grains become unstable, and the nucleation magnetic field of the main phase crystal grain also varies widely, so that the minor curve flatness tends to decrease.

The lower limit of D90 is preferably smaller, but it is not smaller than D50. Therefore, the lower limit of D90 corresponds to the lower limit of D50.

In the present embodiment, D50 is the diameter (circle equivalent diameter) of a circle having an area where the cumulative distribution of the area of the main phase crystal grains is 50% and D90 is the circle equivalent diameter of a circle having an area where the cumulative distribution of the area of the main phase crystal grains is 90%.

The area of the main phase crystal grains may be measured, for example, by the area of the main phase crystal grains appearing when a cross section of the sintered magnet is observed. Specifically, the polished cross section of the sintered magnet is observed by a scanning electron microscope (SEM), and obtained a reflected electron composition image (COMPO). The cross section may be parallel to the orientation axis, orthogonal to the orientation axis, or may be at any angle with the orientation axis. Further, in the cross section, the magnification may be set to a magnification capable of recognizing intergranular grain boundary phases of 20 nm or more, for example, 10,000 times or more.

By binarizing the image of the obtained reflected electron image, it is possible to identify the region which is the main phase crystal grain and the region which is the grain boundary phase, and the area of the main phase crystal grain can be calculated.

Binarization can be performed with reference to a signal intensity of the reflected electron image. It is known that the signal intensity of the reflected electron image becomes stronger as the content of the element having a large atomic number is larger. Rare earth elements having a large atomic number exist more in the grain boundary phase region than in the main phase crystal grain region. Thus, it is possible to identify the main phase crystal grain region and the grain boundary phase region by binarizing at a predetermined level. In addition, by binarizing at the time of measurement, even if a region that is an intergranular grain boundary formed between two main phase crystal grains is not specified, the unspecified area of the region of the intergranular grain boundary is within an error range of the area of the entire grain boundary phase region. Therefore, it does not affect the area of the main phase crystal grain region.

In the present embodiment, the number of main phase crystal grains for measuring the area is preferably about 150 to 300 pieces.

(2.2 Grain Boundary Phase)

As shown in FIG. 2, the grain boundary phases 4 exist between the main phase crystal grains 2. The grain boundary phase 4 is mainly composed of the intergranular grain boundary 4*a* formed between two main phase crystal grains and a triple junction 4*b* formed between three or more main phase crystal grains.

(2.2.1 R-T-B—C Based Compound)

In the present embodiment, the grain boundary phase has a phase composed of the R-T-B—C based compound. Hereinafter, the phase composed of the R-T-B—C based compound is also referred to as the R-T-B—C phase. The R-T-B—C based compound is a compound including at least R, T, B and C. Note that, when R of the R-T-B based permanent magnet is composed of R1, R2 and Sm, one or more selected from R1, R2 and Sm may be included in the R-T-B—C based compound.

In the present embodiment, the R concentration in the R-T-B—C based compound is higher than that in the $R_2T_{14}B$ compound constituting the main phase crystal grains. Similarly, the B concentration in the R-T-B—C based compound is higher than the B concentration in the $R_2T_{14}B$ compound constituting the main phase crystal grain. The C concentration in the R-T-B—C based compound is higher than the C concentration in the $R_2T_{14}B$ compound constituting the main phase crystal grain. On the other hand, the T concentration in the R-T-B—C based compound is lower than the T concentration in the $R_2T_{14}B$ compound constituting the main phase crystal grain.

The R-T-B—C phase is formed in the grain boundary phase at the time of sintering. Thus, main phase crystal grains refined by the HDDR process are uniformly grown, so as to obtain a dense sintered magnet. And the average diameter D50 and D90 of the main phase crystal grains can be reduced to be within the above range. In particular, D90 can be reduced. In other words, the growth of the main phase crystal grains can be controlled by forming the R-T-B—C phase in the grain boundary phase, as a result, D50 and D90 of the main phase crystal grains can be within the above range. In this embodiment, it is preferable that the R-T-B—C phase exists at the triple junction 4*b*.

In the present embodiment, a ratio of the area of the R-T-B—C phase to the area of the grain boundary phase is preferably 5% or more and 88% or less. By setting the area ratio of the R-T-B—C phase within the above range, it is possible to control D90 of the main phase crystal grain to be small. As a result, the minor curve flatness of the magnet can be improved.

Further, the area ratio of the R-T-B—C phase is more preferably 12% or more. On the other hand, the area ratio is more preferably 86% or less.

When the area ratio is too large, the sintering temperature at which a dense sintered magnet is obtained tends to be high. If the sintering temperature becomes too high, abnormal grain growth cannot be suppressed even if the R-T-B—C phase is formed. On the other hand, when sintering at a temperature at which abnormal grain growth does not occur, voids tend to be generated in the sintered magnet.

When the area ratio is too small, part of the main phase crystal grains become coarse grains at the sintering temperature at which the dense sintered magnet is obtained, and D90 tends to exceed the above range. As a result, the minor curve flatness tends to decrease.

In this embodiment, in the R-T-B—C phase, a ratio B/R of B atoms to R atoms is preferably 0.30 or more and 0.70 or less. By setting B/R within the above range, D90 of the main phase crystal grain can be controlled to be small.

When B/R is too large, at the sintering temperature at which the dense sintered magnet is obtained, part of the main phase crystal grains become coarse grains and D90 tends to exceed the above range. As a result, the minor curve flatness tends to decrease.

When B/R is too small, the sintering temperature at which a dense sintered magnet can be obtained tends to increase. If the sintering temperature becomes too high, abnormal grain growth cannot be suppressed even if the R-T-B—C phase is formed. On the other hand, when sintering at a temperature at which abnormal grain growth does not occur, voids tend to be formed in the sintered magnet.

Further, in the R-T-B—C phase, it is preferable that a ratio C/R of C atoms to R atoms is 0.60 or more and 1.40 or less. When C/R is within the above range, D90 of the main phase crystal grains can be controlled so as to be small.

When C/R is too large, the sintering temperature at which a dense sintered magnet can be obtained tends to increase. If the sintering temperature becomes too high, abnormal grain growth cannot be suppressed even if the R-T-B—C phase is formed. On the other hand, when sintering at a temperature at which abnormal grain growth does not occur, voids tend to be formed in the sintered magnet.

When C/R is too small, at the sintering temperature at which the dense sintered magnet is obtained, part of the main phase crystal grains become coarse grains and D90 tends to exceed the above range. As a result, the minor curve flatness tends to decrease.

Incidentally, O (oxygen) may be included in the R-T-B—C phase, but its concentration is preferably low. Specifically, a ratio O/R of O atoms to R atoms in the R-T-B—C phase is preferably less than 0.20.

Identification of the R-T-B—C phase can be performed as follows in the present embodiment. The main phase crystal grains and the grain boundary phase are identified from the reflected electron image of the cross section of the R-T-B based permanent magnet, as in the case of measuring the area of the main phase crystal grains described above. Next, using such as EPMA (Electron Probe Micro Analyzer), the distribution of elements present in the cross section is measured and obtained an element mapping data.

From the obtained element mapping data, the average value and the standard deviation of characteristic X-ray intensities of each element of R, T, B, C in the main phase crystal grain region are calculated. Subsequently, in the element mapping data of the cross section, regions in which the value of the characteristic X-ray intensity is larger or smaller than the value (average value+3× standard deviation) of the characteristic X-ray intensity in the main phase crystal grain region and regions are identified in each element. For each element, a region where the value of the property X-ray intensity is larger is defined as a region having a higher concentration than in the main phase crystal grain, while a region where the value of the characteristic X-ray intensity is smaller is defined as a region having a lower concentration than in the main phase crystal grain.

All overlapping regions of a grain boundary phase identified from the reflected electron image, a region in which the concentration of each element R, B and C is larger than that in the main phase crystal grain, and a region in which the concentration of T is smaller than that in the main phase crystal grain, can be identified as R-T-B—C phase in the grain boundary phase. The area ratio of the R-T-B—C phase can be calculated from the area of the grain boundary phase and the area of the R-T-B—C phase.

Also, regarding B/R and C/R, each may be calculated from B concentration, C concentration and R concentration in the R-T-B—C phase identified above.

(2.3 Composition of R-T-B Based Permanent Magnet)

The composition of the R-T-B based permanent magnet is not particularly limited as long as it is controlled so that the $R_2T_{14}B$ compound described above is the main phase. For example, R content in the R-T-B based permanent magnet is 14 at % or more and 20 at % or less, T content in the R-T-B based permanent magnet is 70 at % or more and 82 at % or less, and B content in the R-T-B based permanent magnet is 4 at % or more and 7 at % or less.

The R-T-B based permanent magnet may include at least one of Al, Cu, Zr, Nb, and Ga, which promotes a reaction of the main phase crystal grains during the powder metallurgy step. The content of these elements is preferably 0.5 to 4 at %. By adding these elements to the R-T-B based permanent magnet, it is possible to remove distortion, defects, etc. by reacting the surface layer of the main phase crystal grains.

In addition, the R-T-B based permanent magnet may include titanium (Ti), bismuth (Bi), tin (Sn), tantalum (Ta), silicon (Si), vanadium (V), silver (Ag), germanium (Ge), etc. It may also include unavoidable impurities such as impurities derived from raw materials, impurities mixed when producing, etc. In the present embodiment, it is preferable that the total content of the above-mentioned elements such as Ti and unavoidable impurities is one at % or less with respect to the R-T-B based permanent magnet.

The R-T-B based permanent magnet includes carbon (C). In the present embodiment, C content may be included so as to form the R-T-B—C phase in the grain boundary phase. For example, C content in the sintered magnet is preferably 2,000 ppm or more, more preferably 3,000 ppm or more, further preferably 4,000 ppm or more, and particularly preferably 5,000 ppm or more.

On the other hand, the upper limit of the C content is not particularly limited as long as the properties required for the variable magnetic flux magnet are obtained. It is preferably 10,000 ppm or less in the present embodiment.

In addition, the R-T-B based permanent magnet may include oxygen (O). O (oxygen) content is preferably 1,000 to 8,000 ppm. If O content is too small, the corrosion resistance of the magnet becomes insufficient. If O content is too large, the liquid phase is not sufficiently formed in the magnet and the coercive force decreases. In order to obtain better corrosion resistance and coercive force, it is preferably 1,500 to 3,000 ppm.

In addition, the R-T-B based permanent magnet may include nitrogen (N). N content is preferably 8,000 ppm or less. If N content is too large, the coercive force tends to be insufficient.

The composition of the R-T-B based permanent magnet after sintering can be measured by, for example, ICP-AES (Inductively Coupled Plasma Atomic Emission Spectroscopy).

As a method of measuring the amounts of oxygen, carbon, and nitrogen in the R-T-B based permanent magnet after sintering, conventionally well-known methods can be used. The amount of oxygen is measured, such as by an inert gas fusion-non dispersion type infrared absorption method, the carbon content is measured, such as by a combustion in an oxygen stream-infrared absorption method and the amount of nitrogen is measured such as by an inert gas fusion-thermal conductivity method.

3. Process for the Production of the R-T-B Based Permanent Magnet

Next, an example of processes for the production of the R-T-B based permanent magnet according to the present embodiment will be described below.

(3.1 Alloy Producing Step)

First, a raw material metal for producing the R-T-B based permanent magnet according to the present embodiment is prepared. The raw material metal is melted in a vacuum or in inert gas atmosphere to prepare a raw material alloy having a predetermined composition.

As a raw material metal, rare earth metals or rare earth alloys, pure iron, ferroboron, and alloys thereof are exemplified. The composition of the raw material alloy may be adjusted according to the composition of the desired R-T-B based permanent magnet. Further, at the time of melting, raw material metals such as Al, Cu, Zr, Nb, Ga, etc. may be added as an additional element.

The method of dissolving the raw material metal to obtain the raw material alloy is not particularly limited as long as it is a known dissolution method, and a strip cast method, a high frequency induction dissolution, etc. are exemplified. As atmosphere during melting, vacuum or inert gas is preferable, and argon (Ar) atmosphere is more preferable.

In the strip casting method, a molten melt of the raw material alloy obtained by dissolving the raw material metal in a non-oxidizing atmosphere such as an Ar atmosphere is tapped on the surface of a rotating roll. The melt quenched with the roll is quenched and solidified in the form of a thin sheet or a flake (a scale) form. The quenched and solidified alloy has a homogeneous structure with the crystal grain size of one μm to 50 μm. In addition, an alloy obtained by the reduction diffusion method can also be used as the raw material alloy.

In the present embodiment, as a method of producing a magnet using the raw material alloy, a so-called single alloy method using one type of the raw material alloy is adopted. However, a so-called mixing method, using a raw material alloy (a low R alloy) for forming the main phase mainly including $R_2T_{14}B$ compound as a main phase crystal grain and a raw material alloy (a high R alloy) for forming a grain boundary phase including R more than the low R alloy and effectively contributing to the formation of the grain boundary phase, may be adopted.

(3.1.1 HDDR Process)

In the present embodiment, HDDR (Hydrogenation-Disproportionation-Desorption-Recombination) process is performed on the raw material alloy. The HDDR process is a process to chemically obtain a powder including a refined crystal grains by sequentially performing hydrogenation, disproportionation, desorption (dehydrogenation), and recombination of the raw material alloy. By producing the R-T-B based permanent magnet by using the powder obtained by the HDDR process, the diameter of the main phase crystal grains after sintering can be reduced and the particle size distribution thereof can be narrowed.

In the HDDR process, the raw material alloy is held at 700° C. to 900° C. in $H_2$ gas atmosphere or a mixed atmosphere of $H_2$ gas and an inert gas, thereby hydrogenating the raw material alloy. Then the raw material alloy is dehydrated at 700° C. to 900° C. until the partial pressure of $H_2$ gas in the atmosphere becomes 13 Pa or less, then cooled. As a result, an HDDR alloy having a microstructure can be obtained.

(3.2 Pulverizing Step)

The raw material alloy produced is subjected to a pulverizing step. In the case of the mixing method, the low R alloy and the high R alloy are pulverized separately or together. The pulverizing step is divided into a coarse pulverizing step and a fine pulverizing step. First, the HDDR alloy is coarsely pulverized until the particle diameter reaches about several hundred μm.

For the coarse pulverizing, hydrogen pulverization, in which pulverization is carried out by absorbing hydrogen into the raw material alloy and then discharging, is effective. Hydrogen release treatment is carried out with the aim of reducing hydrogen serving as an impurity to the rare earth sintered magnet. The temperature when absorbing hydrogen is a room temperature. Holding temperature for dehydrogenation after absorbing hydrogen is set to 200 to 400° C. or more, preferably 300° C. The holding time varies depending on the relationship with the holding temperature, the composition and the weight of the raw alloy, etc. And it is set to at least 30 minutes or more, preferably one hour or more per one kg. The hydrogen discharge treatment is carried out in vacuum or in Ar gas flow.

In the present embodiment, the coarse pulverizing step is preferably the hydrogen pulverization, but a mechanical coarse pulverization may also be performed on the HDDR alloy by using a stamp mill, a jaw crusher, a brown mill, etc.

After the coarse pulverizing step, the fine pulverizing step is carried out. For fine pulverization, a jet mill is mainly used, and the powder after the coarse pulverization having a particle size of about several hundred μm is pulverized to have an average particle diameter of 1.2 μm to 4 μm, preferably 1.5 μm to 3 μm. The jet mill generates a high speed gas flow by releasing the high pressure inert gas from a narrow nozzle and accelerates the coarse pulverized powder by this high speed gas flow, therefore, the coarse pulverized powder is finely pulverized by colliding with each other and colliding with the target or the container wall. The pulverized powder is classified by a classifying rotor within the pulverizer and a downstream cyclone of the pulverizer.

Wet pulverizing may be used for the fine pulverizing. For the wet pulverizing, a ball mill, a wet attritor, etc. is used. The coarse pulverized powder having a particle diameter of about several hundred μm is pulverized to have an average particle diameter of 1.5 μm to 4 μm, preferably 2 μm to 3 μm. In the wet pulverizing, by selecting an appropriate dispersion medium, the pulverization proceeds without the alloy powder to contact with oxygen, so that a fine powder having a low oxygen concentration can be obtained.

In the present embodiment, as a C source of the R-T-B—C phase and for the purpose of lubrication during the pressing step mentioned below, improvement of the magnet orientation, etc., fatty acids, derivatives of the fatty acids, hydrocarbons, etc. can be added in an amount of about 0.1 wt % to 2.0 wt % at the time of fine pulverization and/or after the fine pulverization.

As the fatty acid or derivative of the fatty acid, stearic acid zinc, stearic acid calcium, stearic acid aluminum, stearic acid amide, oleic acid amide, ethylene bisisostearic acid amide, lauride acid amide, etc. can be exemplified. As the hydrocarbons, paraffin, naphthalene, etc. can be exemplified.

(3.3 Pressing Step)

Subsequently, the fine pulverized powder is pressed. In the present embodiment, pressing is performed while applying a magnetic field. The pressing pressure of pressing in the magnetic field may be in the range of 0.3 ton/cm$^2$ to 3 ton/cm$^2$ (30 MPa to 300 MPa). The pressing pressure may be constant from the beginning to the end of pressing, may be gradually increased or gradually decreased, or may be irregularly changed. The lower the pressing pressure is, the better the orientation is. However, if the pressing pressure is too low, the strength of the molded body will be insufficient and there will be a problem in handling, therefore, the pressing pressure may be set in consideration of this point. The final relative density of the molded body obtained by pressing in a magnetic field is usually 40% to 60%.

The applied magnetic field may be about 960 kA/m to about 1600 kA/m. The applied magnetic field is not limited to a static magnetic field, and it may be a pulse-like magnetic field. Also, the static magnetic field and the pulse-like magnetic field can be used in combination.

(3.4 Sintering Step)

The molded body is subjected to a sintering step. The sintering is performed in a vacuum or in an inert gas atmosphere. The holding temperature and the holding time may be adjusted in consideration of the composition of the magnet, the pulverization method of the alloy powder, the average diameter and the diameter distribution of the main phase crystal grains, etc. In the present embodiment, it is preferable that the holding temperature is 800° C. to 1000° C. and the holding time is one minute to 20 hours. More preferably, the holding time is four hours to 20 hours.

In the present embodiment, since the R-T-B—C phase is formed in the grain boundary phase at the time of sintering, abnormal growth of the $R_2T_{14}B$ crystal grains refined by the HDDR process is suppressed, resulting to a grain growth to some extent in a state where a narrow grain size distribution is maintained. As a result, the diameter of the main phase crystal grains may be within the range of D50 and D90 described above.

After sintering, the obtained sintered magnet may be subjected to an aging. Conditions of the aging treatment may be appropriately set in consideration of the microstructure of the sintered magnet. For example, the aging temperature may be set to a temperature range of 400° C. to 900° C.

4. Effects in the Present Embodiment

In this embodiment, in order to obtain the R-T-B based permanent magnet suitable for a variable magnetic flux magnet, R-T-B—C phase having higher R concentration, B concentration and C concentration than those in the main phase crystal grains and lower T concentration than that in main phase crystal grains, exists in the grain boundary phase between the main phase crystal grains including the $R_2T_{14}B$ compound. The R-T-B—C phase is formed in the grain boundary phase at the time of sintering, whereby growth of the main phase crystal grains can be controlled. Growth of the main phase crystal grains are carried out to the extent the dense sintered magnet can be obtained and an abnormal growth of the main phase crystal grains can be suppressed.

As a result, the D50 and D90 of the main phase crystal grains can be set within the above range, the single domain structure of the main phase crystal grains is stabilized and the variation of the nucleation magnetic field of the main phase crystal grains is suppressed. Therefore, with the nucleation type magnet, it solves the problems of magnetizability at low magnetic field and steepness of the minor loop, which was mechanically difficult to solve. Thus, even though it is the R-T-B based permanent magnet, it is possible to achieve the properties necessary for the variable magnetic flux magnet, in particular, a good minor curve flatness.

In addition, as the rare earth element included in the R-T-B based permanent magnet, by replacing R1 with a rare earth element which can lower the high anisotropic magnetic field of the $R1_2T_{14}B$ compound represented by the $Nd_2T_{14}B$ compound, a low coercive force can be realized while maintaining necessary properties for the variable magnetic flux magnet. In particular, by controlling the substitution ratio of Y and Ce to R1 and the substitution ratio of Sm to R1, the magnetizing field is also lowered while decreasing the coercive force, and the residual magnetic flux density and the minor curve flatness can be improved in the low magnetizing field.

Although the embodiment of the present invention has been described above, the present invention is not limited thereto and modifications may be made in various modes within the scope of the present invention.

EXAMPLES

Hereinafter, the present invention will be described in more detail referring to Examples. However, the present invention is not limited thereto.

Examples 1 to 10

Firstly, raw materials were blended so as to obtain the R-T-B based permanent magnet having the composition shown in Table 1, raw materials thereof were melted and then cast by a strip casting method to obtain a flaky raw material alloy.

Next, the HDDR process was performed to these raw material alloys. In the HDDR process, hydrogenation was performed by maintaining at 800° C. in an $H_2$ gas atmosphere, dehydrogenation treatment was performed at 800° C. until the partial pressure of $H_2$ gas in the atmosphere becomes one Pa or less, and then cooling was performed to obtain an HDDR alloy.

Next, hydrogen pulverization was carried out by the following. After hydrogen was absorbed to the HDDR alloy at room temperature, the heat treatment at 300° C. for one hour in an Ar atmosphere was performed. Then, it was once cooled to room temperature and the heat treatment was again performed at 300° C. for one hour in a vacuum atmosphere. Thereafter, the obtained pulverized material was cooled to room temperature in an Ar atmosphere.

Next, as a carbon source in the grain boundary phase and as a pulverizing aid, 0.1 to 2 mass % of lauride acid amide was added to the coarsely pulverized powder and the coarsely pulverized powder is finely pulverized using a jet mill. Upon fine pulverization, the rotation speed of the classification rotor of the jet mill was adjusted so that the average particle diameter of the fine pulverized powder became 1.5 μm.

The obtained fine pulverized powder was filled in a press mold disposed in an electromagnet, and pressed in a magnetic field where a pressure of 120 MPa was applied while a magnetic field of 1200 kA/m was applied, to obtain a molded body.

Thereafter, the obtained molded body was held in a vacuum at a temperature shown in Table 2 for four hours to be sintered, and then rapidly cooled and obtained a sintered magnet (the R-T-B based permanent magnet). Then, the obtained sintered magnet was subjected to an aging treatment at 590° C. for one hour in an Ar atmosphere, hence, samples of each R-T-B based permanent magnets of Examples 1 to 10 are obtained.

In this example, each step from the above-described HDDR process to sintering was performed in an inert gas atmosphere having an oxygen concentration of less than 50 ppm.

The results of the composition analysis of the obtained samples of Examples 1 to 10 are shown in Table 1. The content of each element shown in Table 1 was measured by ICP emission spectroscopic analysis. Also, x and y were calculated from the composition analysis results, and the relationship between x and y was plotted in FIG. 3.

Table 1

| Sample | Magnet Composition (at %) | | | | | | | | | | | |
|---|---|---|---|---|---|---|---|---|---|---|---|---|
| No. | Nd | Y | Ce | Sm | Fe | Co | B | Ga | Al | Cu | Nb | Zr |
| Ex. 1 | 16.53 | 0.00 | 0.00 | 0.00 | 77.69 | 0.00 | 5.06 | 0.32 | 0.24 | 0.03 | 0.13 | 0.00 |
| Ex. 2 | 16.39 | 0.00 | 0.00 | 0.00 | 77.75 | 0.00 | 5.14 | 0.32 | 0.25 | 0.02 | 0.14 | 0.00 |
| Ex. 3 | 16.79 | 0.00 | 0.00 | 0.00 | 77.45 | 0.00 | 5.04 | 0.32 | 0.25 | 0.02 | 0.13 | 0.00 |
| Ex. 4 | 16.52 | 0.00 | 0.00 | 0.00 | 77.63 | 0.00 | 5.13 | 0.32 | 0.24 | 0.02 | 0.14 | 0.00 |
| Ex. 5 | 16.46 | 0.00 | 0.00 | 0.00 | 77.75 | 0.00 | 5.06 | 0.32 | 0.25 | 0.03 | 0.13 | 0.00 |
| Ex. 6 | 16.63 | 0.00 | 0.00 | 0.00 | 77.45 | 0.00 | 4.96 | 0.32 | 0.38 | 0.03 | 0.22 | 0.00 |
| Ex. 7 | 16.39 | 0.00 | 0.00 | 0.00 | 77.75 | 0.00 | 5.14 | 0.32 | 0.26 | 0.02 | 0.13 | 0.00 |
| Ex. 8 | 16.27 | 0.00 | 0.00 | 0.00 | 77.93 | 0.00 | 5.07 | 0.32 | 0.25 | 0.03 | 0.13 | 0.00 |
| Ex. 9 | 16.83 | 0.00 | 0.00 | 0.00 | 77.27 | 0.00 | 5.18 | 0.31 | 0.24 | 0.02 | 0.14 | 0.00 |
| Ex. 10 | 16.53 | 0.00 | 0.00 | 0.00 | 77.69 | 0.00 | 5.06 | 0.32 | 0.24 | 0.03 | 0.13 | 0.00 |
| Ex. 11 | 15.06 | 1.49 | 0.00 | 0.00 | 77.81 | 0.00 | 4.91 | 0.32 | 0.25 | 0.02 | 0.14 | 0.00 |
| Ex. 12 | 11.66 | 4.76 | 0.00 | 0.00 | 77.93 | 0.00 | 4.92 | 0.32 | 0.25 | 0.02 | 0.14 | 0.00 |
| Ex. 13 | 8.57 | 7.91 | 0.00 | 0.00 | 77.87 | 0.00 | 4.91 | 0.32 | 0.25 | 0.02 | 0.14 | 0.00 |
| Ex. 14 | 5.34 | 11.34 | 0.00 | 0.00 | 77.69 | 0.00 | 4.90 | 0.32 | 0.24 | 0.03 | 0.14 | 0.00 |
| Ex. 15 | 1.98 | 14.51 | 0.00 | 0.00 | 77.87 | 0.00 | 4.91 | 0.32 | 0.25 | 0.03 | 0.13 | 0.00 |
| Ex. 16 | 15.12 | 0.00 | 1.50 | 0.00 | 77.75 | 0.00 | 4.91 | 0.32 | 0.25 | 0.02 | 0.14 | 0.00 |
| Ex. 17 | 11.74 | 0.00 | 4.79 | 0.00 | 77.69 | 0.00 | 5.06 | 0.32 | 0.26 | 0.02 | 0.13 | 0.00 |
| Ex. 18 | 8.61 | 0.00 | 7.95 | 0.00 | 77.81 | 0.00 | 4.91 | 0.32 | 0.25 | 0.03 | 0.13 | 0.00 |
| Ex. 19 | 5.26 | 0.00 | 11.17 | 0.00 | 77.93 | 0.00 | 4.92 | 0.32 | 0.25 | 0.02 | 0.14 | 0.00 |
| Ex. 20 | 1.98 | 0.00 | 14.51 | 0.00 | 77.87 | 0.00 | 4.91 | 0.32 | 0.25 | 0.03 | 0.13 | 0.00 |

With respect to the obtained samples, D50 and D90 of the main phase crystal grains were measured as follows.

First, on the cut surface of the sample, the region of 10 μm square was observed by SEM to obtain the reflected electron image. The obtained reflected electron image was imported in the image analysis software, and the outlines of 200 main phase crystal grains were extracted and obtained the area of main phase crystal grains. The circle equivalent diameters at which the cumulative distribution of the area of the obtained main phase crystal grains are 50% and 90% are determined as D50 and D90, respectively. The results are shown in Table 2.

The surface of the cross section of each obtained sample was shaved by ion milling to remove the influence of oxidation, etc. of the outermost surface. Then in the cross section after the ion milling, a reflected electron image was obtained in a region of 40 μm square and then element mapping (256 points×256 points) of the region was performed using EPMA (Electron Probe Micro Analyzer).

From the obtained reflected electron image and the element mapping data obtained, the area ratio of the R-T-B—C phase in the grain boundary phase was calculated by the following procedure.

The image of the obtained reflected electron image was binarized to identify the main phase crystal grain region and the grain boundary phase region, and the area of the main phase crystal grain and the area of the grain boundary phase were calculated. Note that, binarization was performed based on the signal intensity of the reflected electron image.

From the obtained element mapping data, the average value and the standard deviation of the characteristic X-ray intensities of each element of R, T, B and C in the main phase crystal grain region were calculated. Subsequently, in the element mapping data of the cross section, regions in which the value of characteristic X-ray intensity is larger or smaller than the value (average value+3× standard deviation) of characteristic X-ray intensity in the main phase crystal grain region were identified with respect to each element. For each element, the region where the characteristic X-ray intensity is larger is defined as a region having a higher concentration than that in the main phase crystal grain, and the region where the characteristic X-ray intensity is smaller is defined as a region having a lower concentration than that in the main phase crystal grain.

The overlapping region of a grain boundary phase identified from the reflected electron image, the region in which the concentration of each element of R, B and C is larger than that in the main phase crystal grain, and the region in which the concentration of T is smaller than that in the main phase crystal grain was defined as the R-T-B—C phase in the grain boundary phase and its area was calculated. The area ratio of the R-T-B—C phase was calculated from the area of the grain boundary phase and the area of the R-T-B—C phase. The results are shown in Table 2.

Regarding B/R and C/R, quantitative analysis was carried out in the R-T-B—C phase identified above, and the ratio (B/R) of B atoms to R atoms and the ratio (C/R) of C atoms to R atoms were calculated from the concentration of each element. B/R and C/R were calculated at three points in the R-T-B—C phase, and the average value of the measured values was referred to as the value of (B/R) and (C/R) of the sample. The results are shown in Table 2.

(Calculation of Area Ratio of Voids)

First, in the same manner as described above, the image of the reflected electron image was binarized at a predetermined level, the void part was identified, and the area of the void part was calculated. By dividing the area of the calculated void part by the sum of the area of the main phase crystal grain, the area of the grain boundary phase and the area of the void part, the area ratio of voids in the entire area was calculated. The results are shown in Table 2.

Subsequently, the magnetizing field Hmag, the coercive force HcJ and residual magnetic flux density Br at the magnetizing field Hmag of the obtained sample were measured as follows by using a BH tracer.

Figure 4:
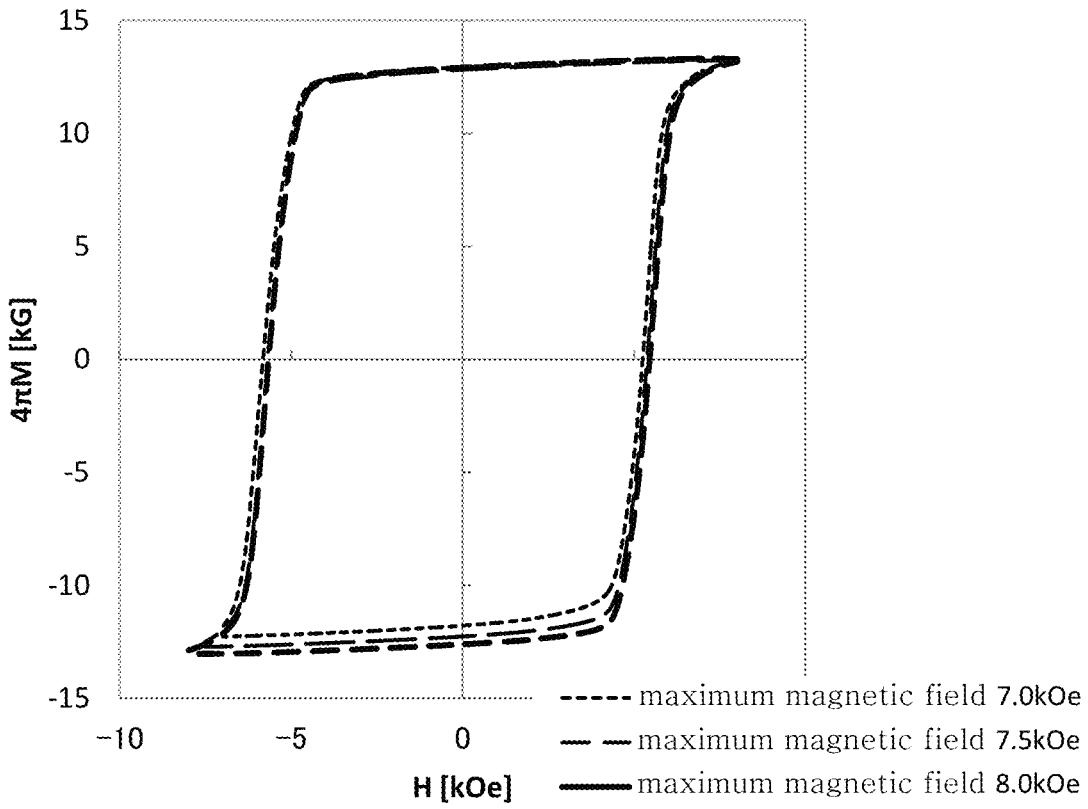
FIG. 4 is a view showing a minor loop in the case where the magnetic field is 7.0 kOe, 7.5 kOe and 8.0 kOe in the examples of the present invention.

First, from the value of the magnetic field equal to the coercive force $HcJ_{-30\ kOe}$ of the J-H hysteresis curve (a major loop) measured at the maximum magnetic field of 30 kOe, the minor loop was measured with increasing the maximum magnetic field at constant intervals, and a value of magnetic field at which the minor loop was closed and a symmetrical shape of the minor loop was obtained was referred to as the magnetizing field Hmag. The measurement result of the minor loop for Example 5 is shown in FIG. 4. Although a closed minor loop was obtained in any of the cases where the magnetic field was 7.0 kOe, 7.5 kOe, 8.0 kOe in FIG. 4, only a minor loop having a symmetrical shape was obtained when the magnetic field was 8.0 kOe. Therefore, the magnetizing field Hmag of Example 5 was 8.0 kOe. In the Examples, the sample having Hmag of 9.0 kOe or less was judged to be good. The results are shown in Table 2.

Subsequently, the coercive force when applying the magnetizing field $H_{mag}$ was referred to as $HcJ_{_Hmag}$, and the residual magnetic flux density when applying the magnetizing field $H_{mag}$ was referred to as $Br_{_Hmag}$. In the Examples, the sample having $HcJ_{_Hmag}$ of 7.5 kOe or less was judged good. In addition, the sample having $Br_{_Hmag}$ of 8.5 kG or more was judged good. The results are shown in Table 2.

Figure 5:
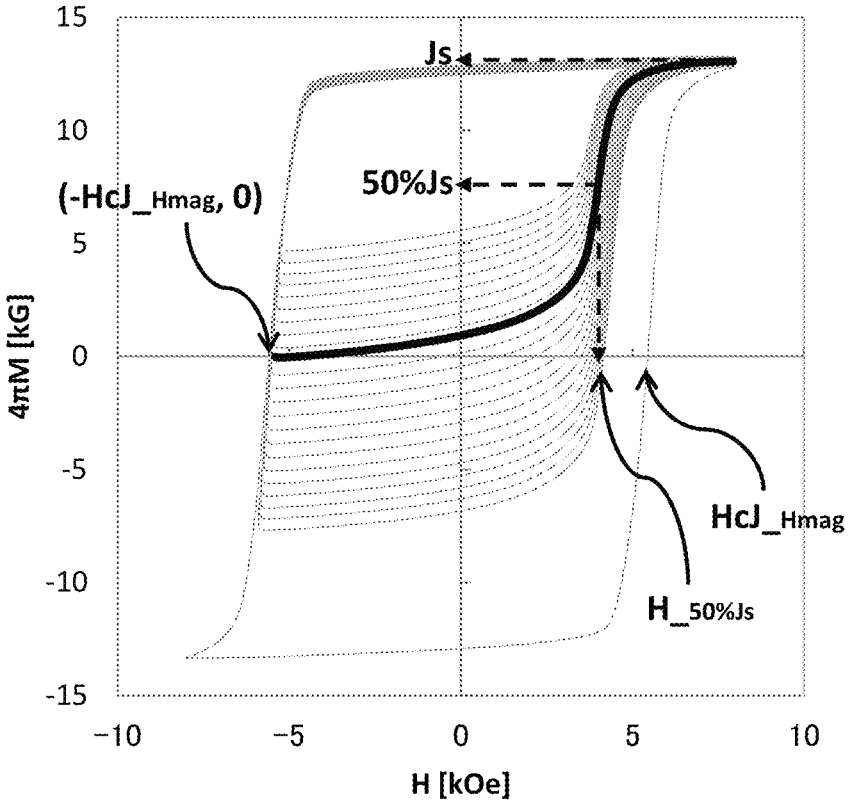
FIG. 5 is a view showing the minor curve flatness in a minor loop when the magnetizing field is 8.0 kOe in the examples of the present invention.

Subsequently, the minor curve flatness was measured as follows. FIG. 5 shows a minor loop group measured for Example 5 while changing the negative reverse magnetic field Hrev. Considering the magnetization curves (a thick line in FIG. 5) from the operating point ($-HcJ_{_Hmag}$, 0) corresponding to the coercive force of the second and third quadrants of the minor loop among the magnetization curves from the plurality of negative reverse magnetic fields Hrev, the ratio ($100\times H_{_50\%\ Js}/HcJ_{_Hmag}$) of the minor loop coercive force $HcJ_{_Hmag}$ and the magnetic field $H_{_50\%\ Js}$ where the magnetic polarization becomes 50% of the magnetic polarization Js when applying the magnetic field Hmag is $H_{_50\%\ Js}$ was taken as the minor curve flatness. In the Examples, it was judged that the samples having the minor curve flatness of 50% or more was good. The results are shown in Table 2.

TABLE 2

| | R-T-B based magnet | | | | | | |
|---|---|---|---|---|---|---|---|
| | Sintered magnet | | | | | | |
| | Rare-earth composition | Sintering temperature (° C.) | Carbon concentration (ppm) | Area ratio of voids (%) | Main phase $R_2T_{14}B$ R | Grain boundary phase R-T-B-C phase B/R | C/R |
| Ex. 1 | Nd100 | 875 | 9240 | 8.3 | Nd | 0.25 | 1.60 |
| Ex. 2 | Nd100 | 875 | 8370 | 5.3 | Nd | 0.28 | 1.50 |
| Ex. 3 | Nd100 | 875 | 7550 | 0 | Nd | 0.30 | 1.40 |
| Ex. 4 | Nd100 | 875 | 6480 | 0 | Nd | 0.34 | 1.00 |
| Ex. 5 | Nd100 | 875 | 5810 | 0 | Nd | 0.37 | 0.70 |
| Ex. 6 | Nd100 | 875 | 5380 | 0 | Nd | 0.56 | 0.68 |
| Ex. 7 | Nd100 | 875 | 4260 | 0 | Nd | 0.64 | 0.63 |
| Ex. 8 | Nd100 | 875 | 3000 | 0 | Nd | 0.70 | 0.60 |
| Ex. 9 | Nd100 | 875 | 2830 | 0 | Nd | 0.76 | 0.58 |
| Ex. 10 | Nd100 | 875 | 1980 | 0 | Nd | — | — |

| | R-T-B based magnet Grain boundary phase | Properties | | | | | |
|---|---|---|---|---|---|---|---|
| | R-T-B-C phase Area ratio of grain boundary phase (%) | Diameter of the main phase crystal grain D50 (μm) | D90 (μm) | Magnetizing field Hmag (kOe) | Coercive force $HcJ_{_Hmag}$ (kOe) | Residual magnetic flux density $Br_{_Hmag}$ (kG) | Minor curve flatness $H_{_50\%\ Js}/HcJ_{_Hmag}$ (%) |
| Ex. 1 | 92 | 0.28 | 0.50 | 9.0 | 7.4 | 8.9 | 87 |
| Ex. 2 | 88 | 0.30 | 0.54 | 8.0 | 6.9 | 10.1 | 86 |
| Ex. 3 | 86 | 0.54 | 0.81 | 8.0 | 6.7 | 11.6 | 85 |
| Ex. 4 | 85 | 0.58 | 0.87 | 8.0 | 6.6 | 12.4 | 84 |
| Ex. 5 | 82 | 0.60 | 0.89 | 8.0 | 6.6 | 12.6 | 83 |
| Ex. 6 | 64 | 0.68 | 1.0 | 8.0 | 5.8 | 12.7 | 76 |
| Ex. 7 | 36 | 0.71 | 1.4 | 8.0 | 5.7 | 12.7 | 70 |
| Ex. 8 | 12 | 0.98 | 2.0 | 7.0 | 4.7 | 12.8 | 60 |
| Ex. 9 | 5 | 1.32 | 2.9 | 7.0 | 4.2 | 12.8 | 50 |
| Ex. 10 | 0 | 1.43 | 3.6 | 6.0 | 1.8 | 12.9 | 25 |

From Table 2, it was confirmed that by forming the R-T-B—C phase, D50 and D90 of the main phase crystal grains were within the above ranges. As a result, it was confirmed that the properties required for the variable magnetic flux magnet are satisfied.

Examples 11 to 20

Samples were prepared in the same manner as in Example 5 or 6, except that Nd as R included in the R-T-B based permanent magnet was partly substituted with Y or Ce as R2 at the ratio shown in Table 2. And the samples were evaluated by the same method as in Example 5 or 6. The results of composition analysis of the samples of Examples 11 to 20 are shown in Table 1. Also, x and y were calculated from composition analysis results, and the relation between x and y was plotted in FIG. 3. The evaluation results of the samples of Examples 11 to 20 are shown in Table 3.

TABLE 3

| | R-T-B based magnet | | | | | | |
|---|---|---|---|---|---|---|---|
| | Sintered magnet | | | | Main phase $R_2T_{14}B$ | | |
| | | | | | R | | |
| | | | | | | R2 | |
| | Rare-earth composition | Sintering temperature (° C.) | Carbon concentration (ppm) | Area ratio of voids (%) | R1 | Element type | x |
| Ex. 5 | Nd100 | 875 | 5810 | 0 | Nd | — | 0.000 |
| Ex. 11 | Nd90Y10 | 875 | 5830 | 0 | Nd | Y | 0.090 |
| Ex. 12 | Nd70Y30 | 900 | 5790 | 0 | Nd | Y | 0.290 |
| Ex. 13 | Nd50Y50 | 900 | 5800 | 0 | Nd | Y | 0.480 |
| Ex. 14 | Nd30Y70 | 900 | 5840 | 0 | Nd | Y | 0.680 |
| Ex. 15 | Nd10Y90 | 900 | 5800 | 0 | Nd | Y | 0.880 |
| Ex. 6 | Nd100 | 875 | 5380 | 0 | Nd | — | 0.000 |
| Ex. 16 | Nd90Ce10 | 875 | 5330 | 0 | Nd | Ce | 0.090 |
| Ex. 17 | Nd70Ce30 | 900 | 5420 | 0 | Nd | Ce | 0.290 |
| Ex. 18 | Nd50Ce50 | 900 | 5410 | 0 | Nd | Ce | 0.480 |
| Ex. 19 | Nd30Ce70 | 900 | 5330 | 0 | Nd | Ce | 0.680 |
| Ex. 20 | Nd10Ce90 | 900 | 5350 | 0 | Nd | Ce | 0.880 |

| | R-T-B based magnet | | | | | | | | |
|---|---|---|---|---|---|---|---|---|---|
| | Grain boundary phase R-T-B-C phase | | | Properties | | | | | |
| | | | | Diameter of the main phase crystal grain | | | | | |
| | B/R | C/R | Area ratio of grain boundary phase(%) | D50 (μm) | D90 (μm) | Magnetizing field Hmag (kOe) | Coercive force $HcJ_{-Hmag}$ (kOe) | Residual magnetic flux density $Br_{-Hmag}$ (kG) | Minor curve flatness $H_{-50\% Js}/HcJ_{-Hmag}$ (%) |
| Ex. 5 | 0.37 | 0.70 | 82 | 0.60 | 0.89 | 8.0 | 6.6 | 12.6 | 83 |
| Ex. 11 | 0.37 | 0.70 | 74 | 0.60 | 0.89 | 7.0 | 5.6 | 12.4 | 80 |
| Ex. 12 | 0.37 | 0.72 | 68 | 0.60 | 0.89 | 6.0 | 3.8 | 11.9 | 74 |
| Ex. 13 | 0.38 | 0.74 | 64 | 0.60 | 0.89 | 5.0 | 3.5 | 11.4 | 72 |
| Ex. 14 | 0.40 | 0.74 | 62 | 0.61 | 0.92 | 3.0 | 1.9 | 11.1 | 65 |
| Ex. 15 | 0.68 | 0.77 | 60 | 0.62 | 0.93 | 3.0 | 1.2 | 10.8 | 61 |
| Ex. 6 | 0.56 | 0.68 | 64 | 0.68 | 1.0 | 8.0 | 5.8 | 12.7 | 76 |
| Ex. 16 | 0.56 | 0.69 | 64 | 0.68 | 1.1 | 7.0 | 5.3 | 12.3 | 75 |
| Ex. 17 | 0.57 | 0.70 | 64 | 0.69 | 1.1 | 6.0 | 4.0 | 11.5 | 74 |
| Ex. 18 | 0.58 | 0.71 | 63 | 0.69 | 1.1 | 5.0 | 3.8 | 11.2 | 72 |
| Ex. 19 | 0.58 | 0.72 | 62 | 0.70 | 1.2 | 4.0 | 2.1 | 11.0 | 66 |
| Ex. 20 | 0.59 | 0.74 | 61 | 0.70 | 1.2 | 3.0 | 1.5 | 10.2 | 63 |

From Table 3, it was confirmed that by substituting part of Nd with Y or Ce, the coercive force can be lowered while satisfying the properties required for the variable magnetic flux magnet.

Examples 21 to 55

Samples were prepared in the same manner as in Examples 1 to 10 except that raw materials were blended so as to obtain the R-T-B based permanent magnets having the compositions shown in Table 4 and the sintering temperature was changed to those shown in Table 5. And the samples were evaluated in the same manner as in Examples 1 to 10. The results of composition analysis of the samples of Examples 21 to 55 are shown in Table 4. Also, x and y were calculated from composition analysis results, and the relationship between x and y was plotted in FIG. 3. The evaluation results of the samples of Examples 21 to 55 are shown in Table 5.

TABLE 4

| Sample | Magnet composition (at %) | | | | | | | | | | | |
|---|---|---|---|---|---|---|---|---|---|---|---|---|
| No. | Nd | Y | Ce | Sm | Fe | Co | B | Ga | Al | Cu | Nb | Zr |
| Ex. 21 | 15.71 | 0.00 | 0.00 | 0.83 | 77.75 | 0.00 | 4.98 | 0.32 | 0.24 | 0.03 | 0.14 | 0.00 |
| Ex. 22 | 13.96 | 0.00 | 1.65 | 0.86 | 77.75 | 0.00 | 5.06 | 0.32 | 0.25 | 0.02 | 0.14 | 0.00 |
| Ex. 23 | 12.30 | 0.00 | 3.28 | 0.82 | 77.81 | 0.00 | 5.06 | 0.32 | 0.24 | 0.03 | 0.14 | 0.00 |
| Ex. 24 | 10.69 | 0.00 | 4.99 | 0.84 | 77.69 | 0.00 | 5.06 | 0.32 | 0.24 | 0.03 | 0.13 | 0.00 |
| Ex. 25 | 7.39 | 0.00 | 8.29 | 0.86 | 77.75 | 0.00 | 4.98 | 0.32 | 0.25 | 0.03 | 0.13 | 0.00 |
| Ex. 26 | 4.13 | 0.00 | 11.49 | 0.84 | 77.75 | 0.00 | 5.06 | 0.32 | 0.25 | 0.02 | 0.14 | 0.00 |
| Ex. 27 | 2.45 | 0.00 | 13.20 | 0.82 | 77.81 | 0.00 | 4.99 | 0.32 | 0.24 | 0.03 | 0.14 | 0.00 |
| Ex. 28 | 15.23 | 0.00 | 0.00 | 1.23 | 77.75 | 0.00 | 5.06 | 0.32 | 0.25 | 0.02 | 0.14 | 0.00 |
| Ex. 29 | 13.59 | 0.00 | 1.65 | 1.24 | 77.81 | 0.00 | 4.99 | 0.32 | 0.25 | 0.02 | 0.14 | 0.00 |

TABLE 4-continued

| Sample | Magnet composition (at %) | | | | | | | | | | | |
|---|---|---|---|---|---|---|---|---|---|---|---|---|
| No. | Nd | Y | Ce | Sm | Fe | Co | B | Ga | Al | Cu | Nb | Zr |
| Ex. 30 | 14.85 | 0.00 | 0.00 | 1.69 | 77.74 | 0.00 | 4.98 | 0.33 | 0.25 | 0.03 | 0.13 | 0.00 |
| Ex. 31 | 13.16 | 0.00 | 1.64 | 1.66 | 77.75 | 0.00 | 5.06 | 0.32 | 0.25 | 0.02 | 0.14 | 0.00 |
| Ex. 32 | 11.58 | 0.00 | 3.31 | 1.64 | 77.69 | 0.00 | 5.06 | 0.32 | 0.25 | 0.02 | 0.14 | 0.00 |
| Ex. 33 | 9.84 | 0.00 | 4.98 | 1.66 | 77.81 | 0.00 | 4.99 | 0.32 | 0.25 | 0.02 | 0.14 | 0.00 |
| Ex. 34 | 6.57 | 0.00 | 8.25 | 1.65 | 77.75 | 0.00 | 5.06 | 0.32 | 0.25 | 0.02 | 0.14 | 0.00 |
| Ex. 35 | 3.29 | 0.00 | 11.52 | 1.65 | 77.74 | 0.00 | 5.06 | 0.33 | 0.25 | 0.03 | 0.13 | 0.00 |
| Ex. 36 | 1.62 | 0.00 | 13.24 | 1.67 | 77.69 | 0.00 | 5.06 | 0.32 | 0.24 | 0.02 | 0.14 | 0.00 |
| Ex. 37 | 14.42 | 0.00 | 0.00 | 2.06 | 77.81 | 0.00 | 4.99 | 0.32 | 0.25 | 0.03 | 0.13 | 0.00 |
| Ex. 38 | 12.77 | 0.00 | 1.65 | 2.06 | 77.81 | 0.00 | 4.99 | 0.32 | 0.25 | 0.03 | 0.13 | 0.00 |
| Ex. 39 | 14.06 | 0.00 | 0.00 | 2.48 | 77.75 | 0.00 | 4.98 | 0.32 | 0.25 | 0.02 | 0.14 | 0.00 |
| Ex. 40 | 12.33 | 0.00 | 1.66 | 2.47 | 77.75 | 0.00 | 5.06 | 0.32 | 0.24 | 0.03 | 0.14 | 0.00 |
| Ex. 41 | 9.04 | 0.00 | 4.94 | 2.49 | 77.74 | 0.00 | 5.06 | 0.33 | 0.25 | 0.02 | 0.14 | 0.00 |
| Ex. 42 | 5.75 | 0.00 | 8.26 | 2.51 | 77.68 | 0.00 | 5.06 | 0.33 | 0.24 | 0.03 | 0.13 | 0.00 |
| Ex. 43 | 2.45 | 0.00 | 11.61 | 2.48 | 77.75 | 0.00 | 4.98 | 0.32 | 0.25 | 0.02 | 0.14 | 0.00 |
| Ex. 44 | 13.18 | 0.00 | 0.00 | 3.30 | 77.81 | 0.00 | 4.99 | 0.32 | 0.24 | 0.03 | 0.14 | 0.00 |
| Ex. 45 | 13.65 | 0.83 | 0.83 | 1.24 | 77.75 | 0.00 | 4.98 | 0.32 | 0.25 | 0.02 | 0.14 | 0.00 |
| Ex. 46 | 13.18 | 0.82 | 0.82 | 1.65 | 77.81 | 0.00 | 4.99 | 0.32 | 0.24 | 0.03 | 0.14 | 0.00 |
| Ex. 47 | 13.58 | 1.65 | 0.00 | 1.23 | 77.75 | 0.00 | 5.06 | 0.32 | 0.25 | 0.02 | 0.14 | 0.00 |
| Ex. 48 | 13.23 | 1.65 | 0.00 | 1.65 | 77.75 | 0.00 | 4.98 | 0.32 | 0.25 | 0.03 | 0.13 | 0.00 |
| Ex. 49 | 14.01 | 0.00 | 1.70 | 1.27 | 75.61 | 0.00 | 6.10 | 0.34 | 0.26 | 0.03 | 0.00 | 0.67 |
| Ex. 50 | 15.25 | 0.00 | 0.00 | 1.73 | 75.61 | 0.00 | 6.10 | 0.36 | 0.25 | 0.04 | 0.00 | 0.66 |
| Ex. 51 | 13.62 | 0.00 | 1.69 | 1.72 | 75.50 | 0.00 | 6.17 | 0.36 | 0.26 | 0.03 | 0.00 | 0.66 |
| Ex. 52 | 14.00 | 0.85 | 0.85 | 1.27 | 75.59 | 0.00 | 6.14 | 0.34 | 0.25 | 0.04 | 0.00 | 0.67 |
| Ex. 53 | 13.63 | 0.85 | 0.85 | 1.70 | 75.52 | 0.00 | 6.13 | 0.36 | 0.25 | 0.04 | 0.00 | 0.67 |
| Ex. 54 | 14.00 | 1.70 | 0.00 | 1.27 | 75.58 | 0.00 | 6.13 | 0.36 | 0.25 | 0.04 | 0.00 | 0.67 |
| Ex. 55 | 13.58 | 1.70 | 0.00 | 1.70 | 75.58 | 0.00 | 6.14 | 0.35 | 0.25 | 0.04 | 0.00 | 0.67 |
| Ex. 56 | 14.87 | 0.00 | 0.00 | 1.67 | 77.18 | 0.58 | 4.98 | 0.32 | 0.25 | 0.03 | 0.13 | 0.00 |
| Ex. 57 | 14.84 | 0.00 | 0.00 | 1.69 | 76.53 | 1.15 | 5.06 | 0.33 | 0.24 | 0.03 | 0.13 | 0.00 |

TABLE 5

| | R-T-B based magnet | | | | | | | |
|---|---|---|---|---|---|---|---|---|
| | Sintered magnet | | | | Main phase $R_2T_{14}B$ | | | |
| | | | | | R | | | |
| | | | | | | R2 | | |
| | Rare-earth composition | Sintering temperature (° C.) | Carbon concentration (ppm) | Area ratio of voids (%) | R1 | Element type | x | Sm y |
| EX. 21 | Nd95Sm5 | 875 | 5350 | 0.0 | Nd | — | 0.000 | 0.050 |
| EX. 22 | Nd85Ce10Sm5 | 875 | 5360 | 0.0 | Nd | Ce | 0.100 | 0.052 |
| EX. 23 | Nd75Ce20Sm5 | 875 | 5390 | 0.0 | Nd | Ce | 0.200 | 0.050 |
| EX. 24 | Nd65Ce30Sm5 | 875 | 5430 | 0.0 | Nd | Ce | 0.302 | 0.051 |
| EX. 25 | Nd45Ce50Sm5 | 900 | 5400 | 0.0 | Nd | Ce | 0.501 | 0.052 |
| EX. 26 | Nd25Ce70Sm5 | 900 | 5370 | 0.0 | Nd | Ce | 0.698 | 0.051 |
| EX. 27 | Nd15Ce80Sm5 | 900 | 5310 | 0.0 | Nd | Ce | 0.801 | 0.050 |
| EX. 28 | Nd92.55m7.5 | 850 | 5370 | 0.0 | Nd | — | 0.000 | 0.075 |
| EX. 29 | Nd82.5Ce10Sm7.5 | 875 | 5380 | 0.0 | Nd | Ce | 0.100 | 0.075 |
| EX. 30 | Nd90Sm10 | 850 | 5430 | 0.0 | Nd | — | 0.000 | 0.102 |
| EX. 31 | Nd80Ce10Sm10 | 850 | 5370 | 0.0 | Nd | Ce | 0.100 | 0.101 |
| EX. 32 | Nd70Ce20Sm10 | 875 | 5380 | 0.0 | Nd | Ce | 0.200 | 0.100 |
| EX. 33 | Nd60Ce30Sm10 | 875 | 5340 | 0.0 | Nd | Ce | 0.302 | 0.101 |
| EX. 34 | Nd40Ce50Sm10 | 900 | 5420 | 0.0 | Nd | Ce | 0.501 | 0.100 |
| EX. 35 | Nd20Ce70Sm10 | 900 | 5430 | 0.0 | Nd | Ce | 0.700 | 0.100 |
| EX. 36 | Nd10Ce80Sm10 | 900 | 5410 | 0.0 | Nd | Ce | 0.801 | 0.101 |
| EX. 37 | Nd87.55m12.5 | 850 | 5380 | 0.0 | Nd | — | 0.000 | 0.125 |
| EX. 38 | Nd77.5Ce10Sm12.5 | 850 | 5360 | 0.0 | Nd | Ce | 0.100 | 0.125 |
| EX. 39 | Nd85Sm15 | 850 | 5350 | 0.0 | Nd | — | 0.000 | 0.150 |
| EX. 40 | Nd75Ce10Sm15 | 850 | 5410 | 0.0 | Nd | Ce | 0.101 | 0.150 |
| EX. 41 | Nd55Ce30Sm15 | 875 | 5350 | 0.0 | Nd | Ce | 0.300 | 0.151 |
| EX. 42 | Nd35Ce50Sm15 | 900 | 5430 | 0.0 | Nd | Ce | 0.500 | 0.152 |
| EX. 43 | Nd15Ce70Sm15 | 900 | 5350 | 0.0 | Nd | Ce | 0.702 | 0.150 |
| EX. 44 | Nd80Sm20 | 850 | 5450 | 0.0 | Nd | — | 0.000 | 0.200 |
| EX. 45 | Nd82.5Y5Ce5Sm7.5 | 875 | 5370 | 0.0 | Nd | Y + Ce | 0.100 | 0.075 |
| EX. 46 | Nd80Y5Ce5Sm10 | 850 | 5390 | 0.0 | Nd | Y + Ce | 0.100 | 0.100 |
| EX. 47 | Nd82.5Y10Sm7.5 | 875 | 5380 | 0.0 | Nd | Y | 0.100 | 0.075 |
| EX. 48 | Nd80Y10Sm10 | 850 | 5360 | 0.0 | Nd | Y | 0.100 | 0.100 |
| EX. 49 | Nd82.5Ce10Sm7.5 | 875 | 5360 | 0.0 | Nd | Ce | 0.100 | 0.075 |
| EX. 50 | Nd90Sm10 | 850 | 5360 | 0.0 | Nd | — | 0.000 | 0.102 |
| EX. 51 | Nd80Ce10Sm10 | 850 | 5410 | 0.0 | Nd | Ce | 0.099 | 0.101 |

TABLE 5-continued

| | | | | | | | | |
|---|---|---|---|---|---|---|---|---|
| EX. 52 | Nd82.5Y5Ce5Sm7.5 | 875 | 5380 | 0.0 | Nd | Y + Ce | 0.100 | 0.075 |
| EX. 53 | Nd80Y5Ce5Sm10 | 850 | 5430 | 0.0 | Nd | Y + Ce | 0.100 | 0.100 |
| EX. 54 | Nd82.5Y10Sm7.5 | 875 | 5340 | 0.0 | Nd | Y | 0.100 | 0.075 |
| EX. 55 | Nd80Y10Sm10 | 850 | 5390 | 0.0 | Nd | Y | 0.100 | 0.100 |
| EX. 56 | Nd90Sm10 | 850 | 5390 | 0.0 | Nd | — | 0.000 | 0.101 |
| EX. 57 | Nd90Sm10 | 850 | 5420 | 0.0 | Nd | — | 0.000 | 0.102 |

| | R-T-B based magnet | | | | | | | | |
|---|---|---|---|---|---|---|---|---|---|
| | Grain boundary phase | | | Properties | | | | | |
| | R-T-B-C phase | | | Diameter of the main phase crystal grain | | | | | |
| | B/R | C/R | Area ratio of grain boundary phase(%) | D50 (μm) | D90 (μm) | Magnetizing field Hmag (kOe) | Coercive force $HcJ_{_Hmag}$ (kOe) | Residual magnetic flux density $Br_{_Hmag}$ (kG) | Minor curve flatness $H_5_{0\%\ Jc}/HcJ_{_Hmag}$ (%) |
| EX. 21 | 0.57 | 0.69 | 64 | 0.68 | 1.0 | 6.0 | 3.9 | 13.0 | 75 |
| EX. 22 | 0.57 | 0.70 | 64 | 0.68 | 1.1 | 6.0 | 3.7 | 12.6 | 74 |
| EX. 23 | 0.57 | 0.70 | 63 | 0.68 | 1.1 | 5.0 | 3.0 | 12.3 | 72 |
| EX. 24 | 0.57 | 0.71 | 63 | 0.69 | 1.1 | 5.0 | 2.7 | 11.8 | 69 |
| EX. 25 | 0.58 | 0.72 | 63 | 0.69 | 1.1 | 4.0 | 2.0 | 11.6 | 68 |
| EX. 26 | 0.58 | 0.73 | 62 | 0.70 | 1.2 | 3.0 | 1.3 | 11.3 | 66 |
| EX. 27 | 0.59 | 0.74 | 61 | 0.70 | 1.2 | 3.0 | 1.1 | 10.7 | 64 |
| EX. 28 | 0.57 | 0.71 | 64 | 0.69 | 1.1 | 5.0 | 2.7 | 12.6 | 75 |
| EX. 29 | 0.57 | 0.71 | 64 | 0.69 | 1.1 | 5.0 | 2.5 | 12.4 | 73 |
| EX. 30 | 0.58 | 0.71 | 63 | 0.69 | 1.1 | 3.0 | 1.6 | 12.1 | 77 |
| EX. 31 | 0.58 | 0.71 | 63 | 0.69 | 1.1 | 3.0 | 1.5 | 11.7 | 76 |
| EX. 32 | 0.58 | 0.72 | 63 | 0.69 | 1.1 | 3.0 | 1.5 | 11.5 | 73 |
| EX. 33 | 0.58 | 0.72 | 63 | 0.69 | 1.1 | 3.0 | 1.4 | 11.4 | 67 |
| EX. 34 | 0.58 | 0.73 | 62 | 0.70 | 1.2 | 3.0 | 1.2 | 11.2 | 66 |
| EX. 35 | 0.59 | 0.74 | 61 | 0.70 | 1.2 | 2.0 | 1.0 | 11.0 | 64 |
| EX. 36 | 0.60 | 0.75 | 60 | 0.71 | 1.3 | 2.0 | 0.7 | 10.5 | 62 |
| EX. 37 | 0.58 | 0.72 | 63 | 0.69 | 1.1 | 3.0 | 1.3 | 11.8 | 72 |
| EX. 38 | 0.58 | 0.72 | 53 | 0.69 | 1.1 | 3.0 | 1.2 | 11.5 | 72 |
| EX. 39 | 0.59 | 0.72 | 62 | 0.70 | 1.2 | 3.0 | 1.1 | 11.4 | 69 |
| EX. 40 | 0.59 | 0.73 | 62 | 0.70 | 1.2 | 2.0 | 1.0 | 10.9 | 67 |
| EX. 41 | 0.59 | 0.74 | 61 | 0.70 | 1.2 | 2.0 | 0.8 | 10.7 | 66 |
| EX. 42 | 0.59 | 0.75 | 60 | 0.71 | 1.3 | 2.0 | 0.6 | 10.3 | 62 |
| EX. 43 | 0.60 | 0.76 | 60 | 0.71 | 1.3 | 2.0 | 0.5 | 10.1 | 59 |
| EX. 44 | 0.59 | 0.74 | 61 | 0.70 | 1.2 | 2.0 | 0.6 | 10.2 | 66 |
| EX. 45 | 0.57 | 0.71 | 64 | 0.69 | 1.1 | 4.0 | 2.3 | 12.5 | 73 |
| EX. 46 | 0.58 | 0.71 | 63 | 0.69 | 1.1 | 3.0 | 1.3 | 11.9 | 76 |
| EX. 47 | 0.58 | 0.71 | 63 | 0.69 | 1.1 | 4.0 | 2.1 | 12.7 | 72 |
| EX. 48 | 0.58 | 0.72 | 63 | 0.69 | 1.1 | 3.0 | 1.1 | 12.1 | 74 |
| EX. 49 | 0.58 | 0.71 | 63 | 0.69 | 1.1 | 5.0 | 2.8 | 11.9 | 71 |
| EX. 50 | 0.57 | 0.71 | 63 | 0.69 | 1.1 | 4.0 | 2.0 | 11.8 | 74 |
| EX. 51 | 0.58 | 0.70 | 64 | 0.69 | 1.1 | 3.0 | 1.8 | 11.3 | 73 |
| EX. 52 | 0.58 | 0.70 | 64 | 0.69 | 1.1 | 4.0 | 2.6 | 12.2 | 70 |
| EX. 53 | 0.57 | 0.71 | 63 | 0.69 | 1.1 | 3.0 | 1.5 | 11.5 | 73 |
| EX. 54 | 0.58 | 0.71 | 63 | 0.69 | 1.1 | 5.0 | 2.3 | 12.4 | 70 |
| EX. 55 | 0.57 | 0.72 | 62 | 0.69 | 1.1 | 3.0 | 1.3 | 11.9 | 72 |
| EX. 56 | 0.58 | 0.71 | 63 | 0.69 | 1.1 | 4.0 | 1.8 | 12.3 | 77 |
| EX. 57 | 0.57 | 0.71 | 62 | 0.69 | 1.1 | 4.0 | 2.0 | 12.4 | 75 |

As shown in Table 5, by substituting a part of Nd as R1 with R2 and/or Sm improves the residual magnetic flux density and the minor curve flatness in the low magnetizing field while reducing the magnetizing field and the coercive force. In particular, it was confirmed that even better properties can be obtained by setting the substitution ratio (x) of R2 and the substitution ratio (y) of Sm within the range shown in FIG. 3.

Examples 56 and 57

Samples were prepared in the same manner as in Examples 1 to 10 except that raw materials were blended so as to obtain the R-T-B based permanent magnets having the composition shown in Table 4 and the sintering temperature was changed to the temperature shown in Table 5. And the samples were evaluated in the same manner as in Examples 1 to 10. The results of composition analysis of the samples of Examples 56 and 57 are shown in Table 4. Also, x and y were calculated from the composition analysis results, and the relation between x and y was plotted in FIG. 3. The evaluation results of the samples of Examples 56 and 57 are shown in Table 5.

From Table 5, it was confirmed that even if a part of Fe was substituted with Co, the same effects can be obtained from the samples, in which a part of Fe was not substituted with Co.

The R-T-B based permanent magnet of the present invention satisfies the properties required for a variable magnetic flux magnet, and is therefore suitable for a variable magnetic flux magnet.

EXPLANATION OF REFERENCES

1 . . . R-T-B based permanent magnet
2 . . . Main phase crystal grain
4 . . . Grain boundary phase
4*a* . . . intergranular grain boundary
4*b* . . . triple junction

The invention claimed is:

1. An R-T-B based permanent magnet comprising a main phase comprising a compound having an $R_2T_{14}B$ tetragonal structure and a grain boundary phase existing between the main phases, wherein R is at least one rare earth element comprising scandium and yttrium, T is at least one transition metal element comprising iron, or at least two transition metal elements comprising iron and cobalt, the grain boundary comprises an R-T-B—C based compound having a higher R concentration, B concentration and C concentration than a R concentration, B concentration and C concentration of the main phase and having a lower T concentration than a T concentration of the main phase, and a coercive force ($HcJ_{_Hmag}$) is 7.5 kOe or less.

2. The R-T-B based permanent magnet according to claim 1, wherein a ratio of an area of the R-T-B—C based compound to an area of the grain boundary phase is 5% or more and 88% or less.

3. The R-T-B based permanent magnet according to claim 1, wherein a ratio B/R of B atom to R atom satisfies $0.3<B/R<0.7$ and a ratio C/R of C atom to R atom satisfies $0.6<C/R<1.4$ in the R-T-B—C based compound.

4. The R-T-B based permanent magnet according to claim 2, wherein the ratio B/R of B atom to R atom, satisfies $0.3<B/R<0.7$ and the ratio C/R of C atom to R atom satisfies $0.6<C/R<1.4$ in the R-T-B—C based compound.

5. The R-T-B based permanent magnet according to claim 1, wherein when R of the R-T-B based permanent magnet is represented by R1, R2 and Sm, R1 is at least one rare earth element comprising Nd and not comprising Y, Ce and Sm and R2 is at least one element selected from Y and Ce, and when a total number of atoms of R is 1, a ratio of a number of atoms of R2 to the total number of atoms of R is x, and a ratio of a number of atoms of Sm to the total number of atoms of R is y, x and y, being on a (x, y) plane, are on straight lines connecting point A (0.000, 0.050), point B (0.000, 0.150), point C (0.700, 0.100), point D (0.700, 0.000), and point E (0.300, 0.000) in the clockwise direction in this order, and in a region surrounded by the straight lines.

6. The R-T-B based permanent magnet according to claim 2, wherein when R of the R-T-B based permanent magnet is represented by R1, R2 and Sm, R1 is at least one rare earth element comprising Nd and not comprising Y, Ce and Sm and R2 is at least one element selected from Y and Ce, and when a total number of atoms of R is 1, a ratio of a number of atoms of R2 to the total number of atoms of R is x, and a ratio of a number of atoms of Sm to the total number of atoms of R is y, x and y, being on a (x, y) plane, are on straight lines connecting point A (0.000, 0.050), point B (0.000, 0.150), point C (0.700, 0.100), point D (0.700, 0.000), and point E (0.300, 0.000) in the clockwise direction in this order, and in a region surrounded by the straight lines.

7. The R-T-B based permanent magnet according to claim 3, wherein when R of the R-T-B based permanent magnet is represented by R1, R2 and Sm, R1 is at least one rare earth element comprising Nd and not comprising Y, Ce and Sm and R2 is at least one element selected from Y and Ce, and when a total number of atoms of R is 1, a ratio of a number of atoms of R2 to the total number of atoms of R is x, and a ratio of a number of atoms of Sm to the total number of atoms of R is y, x and y, being on a (x, y) plane, are on straight lines connecting point A (0.000, 0.050), point B (0.000, 0.150), point C (0.700, 0.100), point D (0.700, 0.000), and point E (0.300, 0.000) in the clockwise direction in this order, and in a region surrounded by the straight lines.

8. The R-T-B based permanent magnet according to claim 4, wherein when R of the R-T-B based permanent magnet is represented by R1, R2 and Sm, R1 is at least one rare earth element comprising Nd and not comprising Y, Ce and Sm and R2 is at least one element selected from Y and Ce, and when a total number of atoms of R is 1, a ratio of a number of atoms of R2 to the total number of atoms of R is x, and a ratio of a number of atoms of Sm to the total number of atoms of R is y, x and y, being on a (x, y) plane, are on straight lines connecting point A (0.000, 0.050), point B (0.000, 0.150), point C (0.700, 0.100), point D (0.700, 0.000), and point E (0.300, 0.000) in the clockwise direction in this order, and in a region surrounded by the straight lines.

9. The R-T-B based permanent magnet according to claim 1, wherein a residual magnetic flux density ($Br_{_Hmag}$) is 10.1 kG or more.

* * * * *